US006113220A

United States Patent [19]

Ishinaga et al.

[11] Patent Number: 6,113,220

[45] **Date of Patent: *Sep. 5, 2000**

[54] INK JET RECORDING HEAD HAVING SUBSTRATE ARRANGEMENT IN WHICH FUNCTIONAL ELEMENTS ARE OBLIQUELY DISPOSED

[75] Inventors: Hiroyuki Ishinaga, Tokyo; Asao Saito, Yokohama; Toshihiro Mori, Kawasaki, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/931,931

[22] Filed: Sep. 17, 1997

Related U.S. Application Data

[63] Continuation of application No. 08/224,128, Apr. 6, 1994, abandoned, which is a continuation of application No. 07/925,861, Aug. 7, 1992, abandoned, which is a division of application No. 07/645,732, Jan. 24, 1991, Pat. No. 5,182,577.

[30] Foreign Application Priority Data

Jan. 25, 1990 [JP] Japan ..... 2-013489
Jan. 25, 1990 [JP] Japan ..... 2-013490

[51] Int. Cl.[7] ..... B41J 2/05
[52] U.S. Cl. ..... 347/58
[58] Field of Search ..... 347/59, 58, 57, 347/13

[56] References Cited

U.S. PATENT DOCUMENTS

| | | | |
|---|---|---|---|
| 4,099,046 | 7/1978 | Boynton | 347/209 |
| 4,427,988 | 1/1984 | Kermadec | 347/148 X |
| 4,429,321 | 1/1984 | Matsumoto | 347/59 |
| 4,458,256 | 7/1984 | Shirato et al. | 347/58 |
| 4,692,783 | 9/1987 | Monma et al. . | |
| 4,719,477 | 1/1988 | Hess . | |
| 4,769,653 | 9/1988 | Shimoda . | |
| 5,038,192 | 8/1991 | Bonneau et al. . | |
| 5,081,474 | 1/1992 | Shibata | 347/59 |
| 5,175,565 | 12/1992 | Ishinaga | 347/59 X |
| 5,182,577 | 1/1993 | Ishinaga | 347/58 |
| 5,212,503 | 5/1993 | Saito | 347/59 |

FOREIGN PATENT DOCUMENTS

| | | | |
|---|---|---|---|
| 0289347 | 11/1988 | European Pat. Off. | B41J 3/04 |
| 354103054 | 8/1979 | Japan | B41J 3/20 |
| 57-072867 | 5/1982 | Japan | B41J 3/04 |

OTHER PUBLICATIONS

Horowitz, P. et al., "The Art of Electronics" (1989 ed'n.), pp. 842–847.

*Primary Examiner*—John Barlow
*Assistant Examiner*—An H. Do
*Attorney, Agent, or Firm*—Fitzpatrick, Cella, Harper & Scinto

[57] ABSTRACT

A recording head is equipped with a plurality of liquid discharge portions, each having a discharge opening for discharging ink, and a substrate. The substrate is provided with a plurality of electrothermal transducers for generating thermal energy to be utilized for discharging the ink supplied to the liquid discharging portions and a plurality of functional devices connected electrically to the electrothermal transducers. The plurality of functional devices are arranged in a direction diagonal relative to an arrangement direction of the plurality of electrothermal transducers within a region provided with a wiring portion and have different characteristic curves of saturated voltage versus temperature corresponding to the distance from the electrothermal transducers. The region includes common electrode wiring and selective electrode wiring for the plurality of electrothermal transducers and the plurality of functional devices. The plurality of electrothermal transducers are connected to the common electrode wiring. The wiring portion is formed essentially at a layer lower than the layer where the electrothermal transducers are formed.

10 Claims, 25 Drawing Sheets

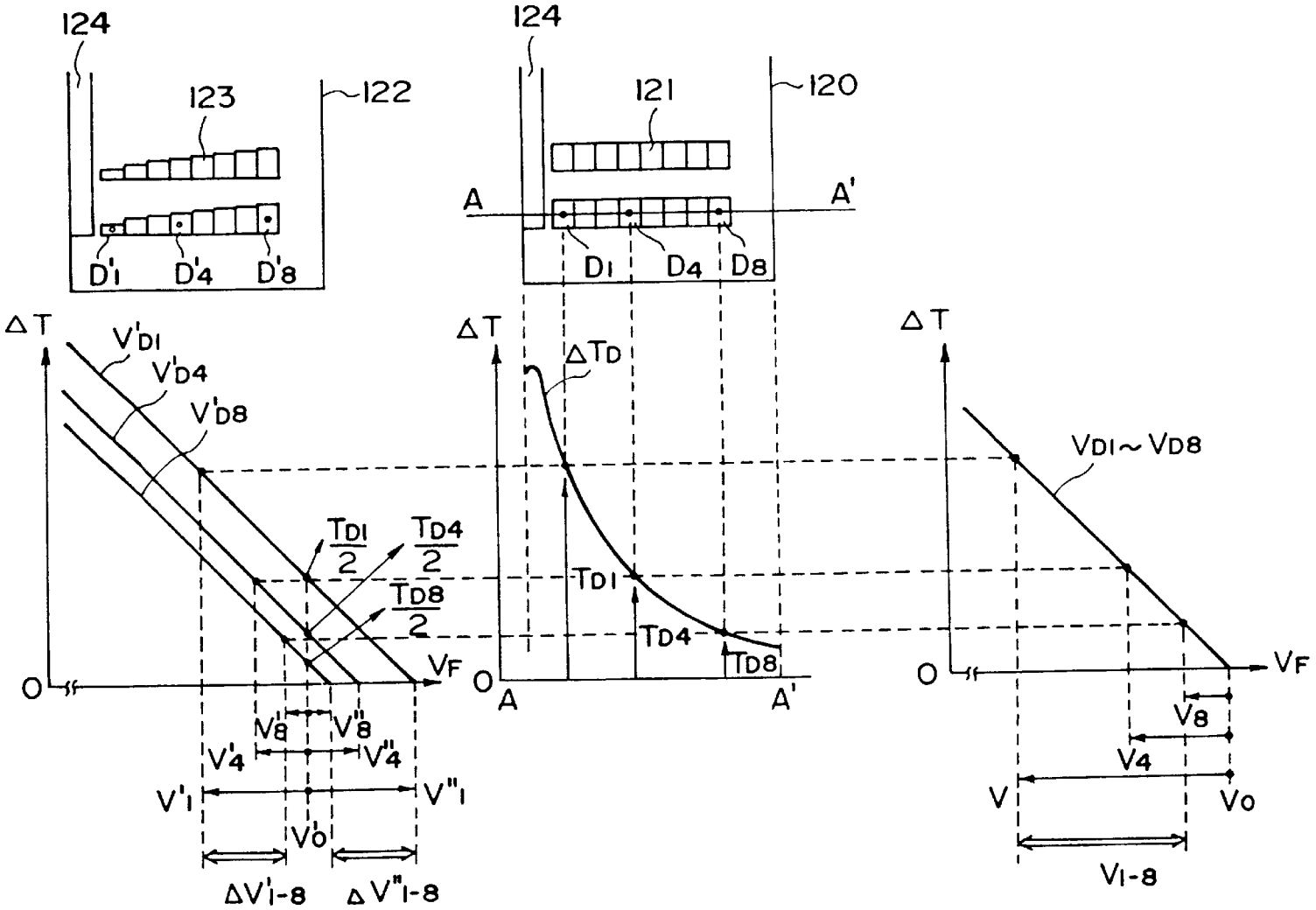
FIG. 5B(I) FIG. 5B(II) FIG. 5B(III)

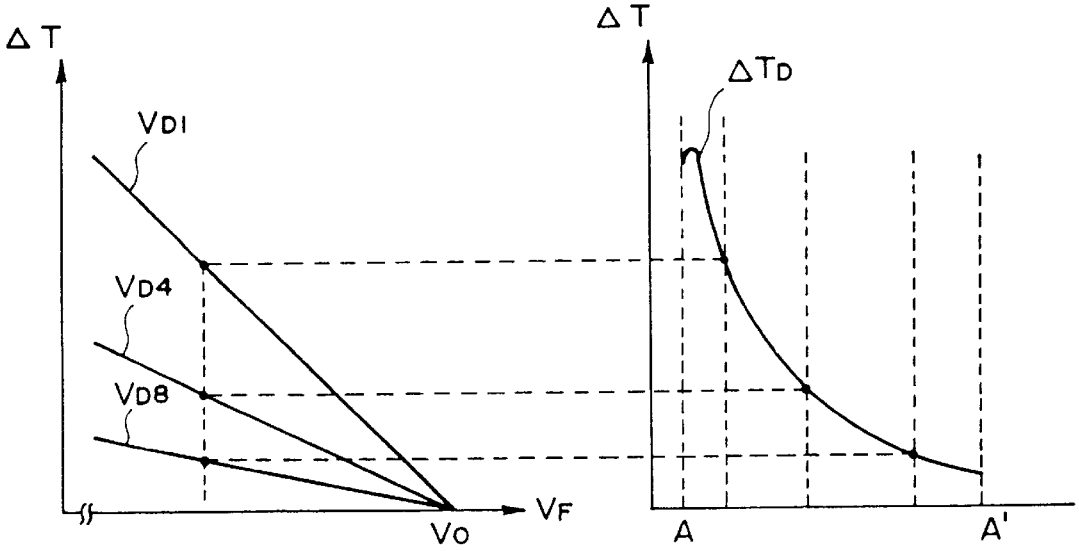
FIG. 6A(II) FIG. 6A(I)

INK JET RECORDING HEAD HAVING SUBSTRATE ARRANGEMENT IN WHICH FUNCTIONAL ELEMENTS ARE OBLIQUELY DISPOSED

This application is a continuation of application Ser No. 08/224,128 filed Apr. 6, 1994, now abandoned, which was a Continuation of application Ser. No. 07/925,861 filed Aug. 7, 1992 now abandoned which was a Division of application Ser. No. 07/645,732 filed Jan. 24, 1991 now U.S. Pat. No. 5,182,577.

BACKGROUND OF THE INVENTION

1. Field of the Invention

This invention relates to a recording head of an ink jet recording device to be used for printer, video output printer, etc. as the terminal for output of copying machine, facsimile, word processor, host computer, a substrate for said head an ink jet recording device, particularly to an ink jet recording head having an electrothermal transducer for generating thermal energy as the energy to be utilized for discharging ink and a functional device for recording formed on or internally of the same substrate, a substrate for said head and an ink jet recording device.

2. Related Background Art

In the prior art, a recording head had a constitution, comprising an array of electrothermal transducers formed on a single crystal silicon substrate, functional devices for driving the electrothermal transducers such as a transistor, a diode array, etc. arranged externally of the silicon substrate as the driving circuit of the electrothermal transducers, with connection between the electrothermal transducers and the functional devices such as transistor array, etc. being done with flexible cable or wire bonding.

For the purpose of simplifying the structure, or reducing defects occurring in the preparation steps, and further improving uniformization of the characteristics of the respective devices and reproduction of high quality head preparation, etc., there has been known an ink jet recording head having electrothermal transducers and functional devices provided on or internally of the same substrate as proposed in Japanese Laid-open Patent Application No. 57-72867.

FIG. 12 is a schematic sectional view showing a part of the recording head having the construction as described above. Numeral 901 is a semiconductor substrate comprising a single crystal silicon. Numeral 902 is the collector region of an N-type semiconductor, 903 the ohmic contact region of an N-type semiconductor with a high impurity concentration, 904 the base region of a P-type semiconductor, 905 the emitter region of an N-type semiconductor with a high impurity concentration, and the bipolar transistor Numeral 920 is formed of these. 906 is a silicon oxide layer as the heat accumulation layer and the insulating layer, 907 a hafnium boride ($HfB_2$) as the heat-generating resistor layer, 908 an aluminum (Al) electrode, 909 a silicon oxide layer as the protective layer, and the recording head substrate 930 is constituted of all the members as mentioned above. Here, 940 becomes the heat generating portion. The ceiling plate 910 is bonded to 930, and sectionalizes the liquid channel communicated to the discharge opening 950A in co-operative fashion.

The substrate for recording head with such constitution (heater board) is connected to functional device arrays such as the array of the heat generating portion (heater) 940 and the array of diodes or transistors for driving this through the matrix wiring portion arranged between these. However, in the constitution of the prior art, because the matrix portion and the functional device portion are arranged at the sites separated on the heater board, the following problems have been involved.

i) The size of the heater board cannot be made small without accompaniment of performance deterioration.

ii) Segment electrodes for driving selectively the heater are located outside of the width of the heater row, whereby the heater board size is larger corresponding thereto, and further continuous arrangement is also impossible.

iii) Wiring resistance is large.

iv) Since the distance from the heater to the functional devices for driving is not uniform, the resistance value correction is difficult.

Also, since many wirings have been applied in the same layer (e.g. the second layer) as the heater layer, there have been such problems as follows:

i) the second layer wiring cannot be made thick because the wiring resistance is made small by the influence of the protective layer of the heater;

ii) the second layer comprises a double structure of both the heater material and the wiring material, and therefore if the second layer portion is much, the yield of bridges, etc. is poor. Further, there has been the problem that high precision is required for the film thickness of the respective layers, because the resistance value correction of the second layer wiring is done in the first layer.

The substrate for recording head with such constitution (heater board) is connected to an array of the heat-generating portions (heater) 940 and an array of functional devices such as an array of diodes or transistors through a matrix wiring portion arranged between these. The functional device array portion is arranged on the heater board gradually departed as the first row, the second row, . . . the nth row from the heater portion.

Therefore, since the distance between the heater portion and the functional device array portion is different for each row, the normal direction voltage of the functional device such as diode or transistor tends to be larger as remote from the heater portion (the substrate temperature becomes lower) depending on the temperature distribution of the heater board, particularly involving the problem that its variance is greater as the temperature of the heater board becomes higher in printing for a long time, etc. to have deleterious effect on printing quality.

SUMMARY OF THE INVENTION

An object of the present invention is to provide an ink jet recording head which can improve thermal efficiency without damaging the life of the heat energy generating member which generates thermal energy to be utilized for discharging ink.

Another object of the present invention is to provide an ink jet recording head which can make the substrate having heat energy generating members arranged thereon compact, thereby accomplishing making the ink jet recording head itself compact.

Still another object of the present invention is to provide an ink jet recording head which can improve printing quality.

It is also another object of the present invention to provide a substrate for ink jet recording head for forming the ink jet recording head as mentioned above.

Still another object of the present invention is to provide an ink jet recording device equipped with the ink jet recording head as mentioned above.

Still another object of the present invention is to provide a recording head equipped with a plurality of liquid discharge portions having a discharge opening for discharging ink, and substrate provided with a plurality of electrothermal transducers for generating thermal energy to be utilized for discharging the ink supplied to said liquid discharging portions and a plurality of functional devices connected electrically to said electrothermal transducers, wherein said plurality of functional devices are arranged in the direction from the arrangement direction of said plurality of electrothermal transducers within the region provided at the wiring portion including the common electrode wiring and the selective electrode wiring for said plurality of electrothermal transducers and said plurality of functional devices, said plurality of electrothermal transducers are arranged in the vicinity thereof to said common electrode wiring, and said wiring portion is formed essentially at lower layer than the layer where said electrothermal transducers are formed.

Still another object of the present invention is to provide a substrate for recording head provided with a plurality of electrothermal transducers for generating thermal energy, and a plurality of functional devices electrically connected to said electrothermal transducers on and internally of the same substrate, wherein said plurality of functional devices are arranged in the direction from the arrangement direction of said plurality of electrothermal transducers within the region provided at the wiring portion including the common electrode wiring and the selective electrode wiring for s aid plurality of electrothermal transducers and said plurality of functional devices, said plurality of electrothermal transducers are arranged in the vicinity thereof to said common electrode wiring, and said wiring portion is formed essentially at lower layer than the layer where said electrothermal transducers are formed.

Still another object of the present invention is to provide an ink jet recording apparatus equipped with the recording head as specified above, a means for supplying ink to said head, and a means for conveying a recording medium to the recording position with said recording head.

Still another object of the present invention is to provide a recording head equipped with a liquid discharge portion having a liquid discharge opening, and a substrate provided with a plurality of electrothermal transducers for generating thermal energy with said electrothermal transducers being arranged in an alignment direction, and a plurality of functional devices electrically connected to said electrothermal transducers in the same substrate, wherein said plurality of functional devices are arranged diagonally with respect to the alignment direction and have different characteristic curves of saturated voltage versus temperature corresponding to the distance from said electrothermal transducers.

Still another object of the present invention is to provide a substrate for recording head provided with a plurality of electrothermal transducers for generating thermal energy with said electrothermal transducers being arranged in an alignment direction, and a plurality of functional devices electrically connected to said electrothermal transducers in the same substrate, wherein said plurality of functional devices are arranged diagonally with respect to the alignment direction and have different characteristic curves of saturated voltage versus temperature corresponding to the distance from said electrothermal transducers.

Still another object of the present invention is to provide an ink jet recording device equipped with the recording head as specified above, a means for supplying ink to said recording head, and a means for conveying a recording medium to the recording position with said recording head.

According to the inventions as mentioned above, since most of the parts determining the wiring resistance are constituted with the first layer (lower layer) wiring, by making the first layer wiring thicker, the wiring resistance can be made smaller, and also by making the second layer (upper layer) wiring thinner, and the protective layer of the electrothermal transducer (heater) thinner, the heater thermal efficiency can be improved. Also, there occurs no wiring resistance variance on account of film thickness variances of the first layer and the second layer wiring layers.

Further, since the matrix portion and the functional device array portion were made to have double structures, the heater board size can be made compact, and also the wiring resistance is reduced with compaction. Further, it will not be cumbersome for wiring resistance correction.

In addition, according to the present invention, by arranging diodes with chracteristic curves of the normal direction saturated voltage relative to temperature, such as making the diodes arranged in the region where the temperature becomes high on the heater board smaller in size, and by arranging the sizes of the diodes arranged in the region with lower temperature larger, etc., it becomes possible to make the difference in the normal direction voltage of the diodes by the temperature distribution on the heater board uniform without increase of the cost, which in turn enables improvement of printing quality.

Yet another object of this invention is to provide a substrate for a recording head, recording head and ink jet recording apparatus having plural electrothermal transducers and functional devices attached by take-out wiring. The plural functional devices are slipped obliquely so that the take-out wiring can be made linear. This structure allows the design to be simplified, the wiring resistance to be reduced, and the degree of freedom upon the wiring layers improved.

BRIEF DESCRIPTION OF THE DRAWINGS

FIGS. 5B and 5C are illustrations for explanation of the characteristics of the functional device according to the present embodiment;

FIGS. 6A and 6B are respectively illustrations for explanation of other embodiments of the present invention;

DETAILED DESCRIPTION OF THE PREFERRED EMBODIMENTS

Figure 1A:
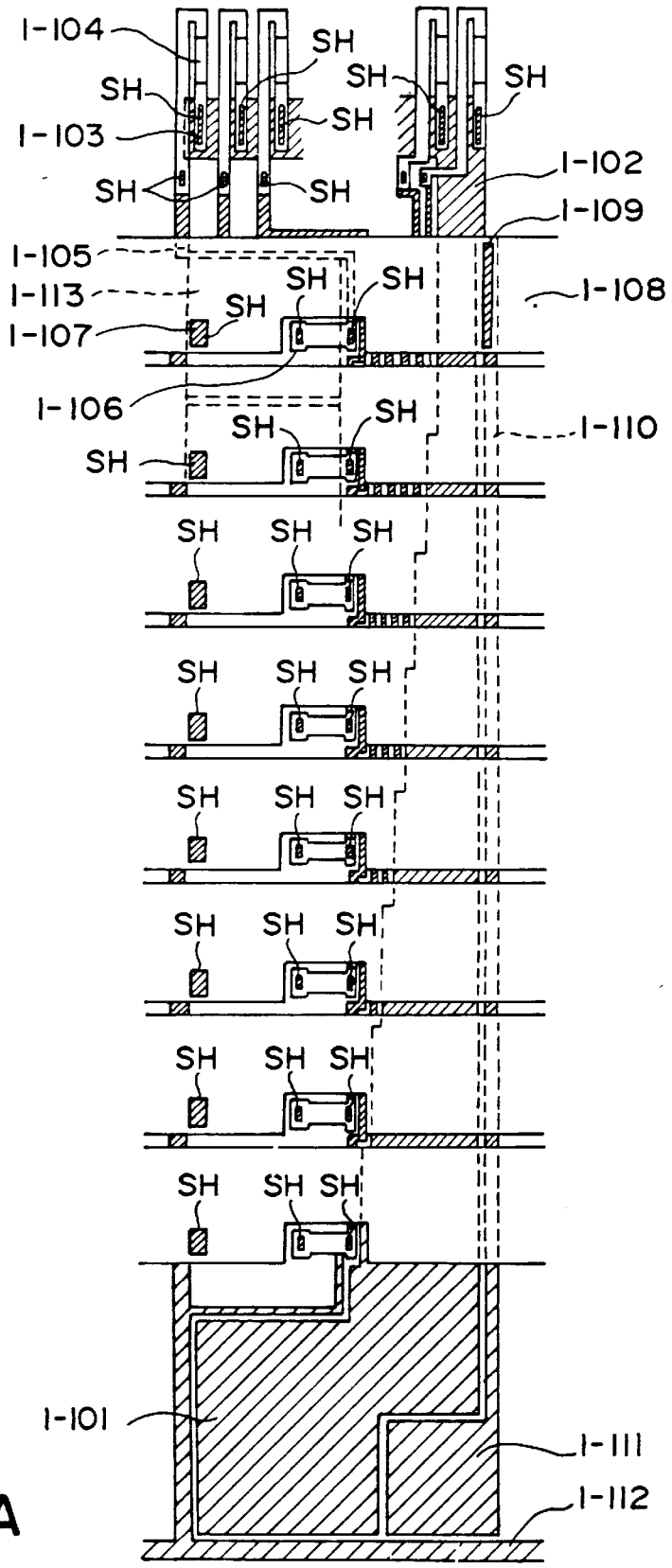
FIGS. 1A, 1B and 1C are respectively a schematic plan view showing the substrate for recording head according to an embodiment of the present invention, a sectional view schematically shown of its wiring portion, and an electrical circuit diagram of the respective portions on the substrate.

Referring now to the drawings, the present invention is described in detail, but the present invention is not limited to the following embodiments, but those which can accomplish the object of the present invention may be included.

FIG. 1A shows an example of wiring arrangement on the substrate (silicon substrate) of the ink jet recording device according to an embodiment of the present invention. Here, the wiring comprises a first layer wiring which becomes the lower layer wiring, a second layer wiring which becomes the upper layer wiring and a thruhole SH which electrically connects them.

In FIG. 1A, 1-101 is a common electrode with the first layer wiring, which is connected to the common wiring 1-102. The common wiring 1-102 is connected to one of the electrothermal transducers 1-104 juxtaposed laterally in an array through the thruhole via the 1-105 common side take-out wiring with the first layer wiring.

The electrothermal transducer 1-104 is formed of a heat generating resistance layer and a second wiring, and connected via the segment side take-out wiring 1-105 to the anode electrode 1-106 of the diode 1-113 which is used as the functional device for driving the electrothermal transducer through the thruhole, the second layer wiring, and the thruhole. The cathode electrode 1-107 of the diode is connected through the thruhole to the segment lateral wiring 1-108. The segment lateral wiring is connected via the thruhole 1-109 to the longitudinal wiring 1-110 with the first layer wiring, and the segment longitudinal wiring to the segment electrode 1-111.

In this Figure, an example with a number of 8 segments of the electrotransducers within one block is shown, and particularly those at the both ends are shown in the drawing. Here, 8 diodes utilized as the functional devices are juxtaposed in the longitudinal direction in FIG. 1A along the arrangement direction of the segment lateral wiring. When the diodes juxtaposed in this manner are actuated, for prevention of erroneous actuation of adjoining mutual diodes, isolation electrodes 1-112 are arranged around the diodes to form an isolation region.

In setting the above-mentioned wiring, the wiring resistance values mutually between the segements are made smaller in difference therebetween by employment of the arrangement as shown in the Figure. More specifically, the wiring resistance depends on the width of the pattern and the total distance wound around of the pattern, and in this embodiment, the common side take-out wiring from the common electrode is made as thick as possible, and also the wiring resistance between segments is suppressed small by taking sufficiently wide the width of the wiring portion which becomes non-common between segments. The wirings from the segment side take-out wiring 1-105 to the diode anode 1-106, and from the segment side thruhole 1-109 to the segment electrode 1-111 may be sometimes restricted in wiring width to tolerate, for example, only 20 $\mu$m or less, and thus are places where wiring resistance is caused to be increased greatly, but by making structurally the arrangement so that the distance wound around may become the same for each segment as the total of the above-mentioned two wirings, it becomes possible to create no great difference mutually between the segments.

That is to say, according to the constitution as described above, since the matrix portion and the diode array portion are housed in the same area, the heater board size becomes smaller and also the wiring becomes shorter, whereby the resistance value becomes smaller.

Also, since the segment electrode does not come out of the area, the size in the width direction can be made smaller, or the device can be made lengthy by continuous arrangement of the heater boards.

Further, since the sum of the segment take-out wiring and the segment longitudinal wiring becomes approximately the same length for each segment, if the wiring width and thickness are made equal, no special correction will be required.

In addition, most of segments are formed from the first layer wiring, and hence most of wiring resistances are due to the first layer wiring. Therefore, by making thinner the thickness of the second layer wiring which has little influence on wiring resistance, the protective layer of the heater can be made thin. At the same time, it has been made possible to make the first layer wiring which does not affect directly the protective layer of the heater and make the wiring resistance smaller, which were antinomic to each other. The second layer comprises a double structure of a heater material and a wiring material, but the second layer has the slight portion of the heater portion and the simple shape pattern of the segment wiring, whereby the yield cannot but be lowered by bridge establishment between the wirings. Further, even if the film thicknesses of the first layer, the second layer may be varied respectively, there will occur no variance of wiring resistance for each segment within the block.

Next, actuation of the ink jet recording device according to the present invention is described.

For driving the resistor 1-104 in a desired electrothermal transducer, the common electrode 1-101 and the segment electrode 1-111 are selected. A pulse for driving passes through the common electrode 1-101 to the common wiring 1-102, the common side take-out wiring 1-103, the electrothermal transducer 1-104, and further through the segment side take-out wiring 1-105 to the anode electrode 1-106 of the diode. Further, passing through the diode, from the diode cathode electrode 107, through the segment lateral wiring 108 and the thruhole 1-109, further passing through the segment longitudinal wiring 1-110 and via the segment electrode 1-111, the pulse flows to the external portion. At this time, because a diode structure is constructed on the P-type silicon substrate for prevention of diode erroneous actuation, the isolation electrode 1-112 is grounded. Here, a driving pulse is added to the electrothermal transducer and the resistor generates heat, whereby the ink immediately thereon is heated, thereby forming discharging ink droplets.

Here, connection of the electrothermal transducer with the diode as the functional device for driving, and driving of the electrothermal transducer are described in more detail.

Figure 1B:
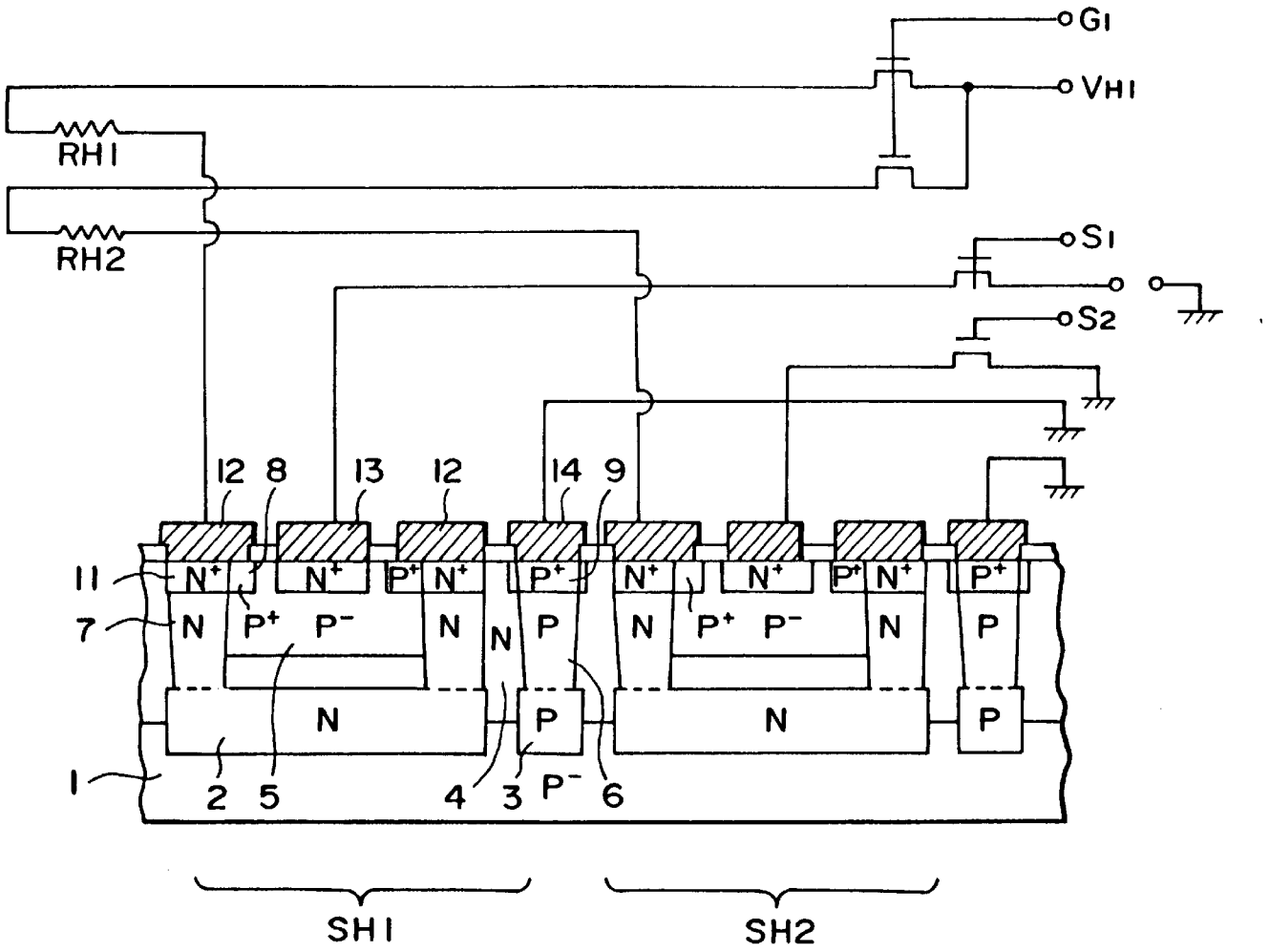

FIG. 1B is a sectional view of the substrate according to the present embodiment with its wiring portion schematically shown. In the present embodiment, as described below by referring to FIG. 2B, the collector base common electrode 12 corresponds to the anode of the diode (1-106 in FIG. 1A), and the emitter electrode 13 to the cathode (1-107 in FIG. 1A). During driving of the electrothermal transducers (RH1, RH2), by applying a bias ($V_{H1}$) of positive potential on the electrothermal transducer connected to the collector base common electrode 12, the NPN transistor within the cell turns on, and the bias current flows out from the emitter electrode 13 as the collector current and the base current.

As the result of the constitution having the base and the collector made short circuited as in the present embodiment, stand-up, stand-down characteristics of heat of the electrothermal transducer were improved, whereby occurrence of film boiling phenomenon and controllability of growth and shrinkage of bubbles accompanied therewith were improved, thereby effecting stable discharging of ink. This may be considered to be due to the fact that in an ink jet recording head utilizing thermal energy, the characteristics of the transistor are deeply related with the characteristics of film boiling, and because of small accumulation of small number of carriers in the transistor, the switching characteristic is rapid to improve the stand-up characteristic, thus having unexpectedly great influences. Also, there is comparatively less parasitic effect without variance between the devices, whereby a stable driving current can be obtained. Concerning the present embodiment, further by grounding the isolation electrode 14, inflow of charges into adjoining other cells can be prevented to prevent the problem of erroneous actuation of other devices.

In such semiconductor device, it is desirable to make the impurity concentration in the N-type collector embedding region 2, $1\times10^{19}$ $cm^{-3}$ or higher, the impurity region in the base region 5, $5\times10^{14}$ to $5\times10^{7}$ $cm^{-3}$, and further the area at the bonded face between the high concentration P-type base region 8 and the electrode as small as possible. By doing so, generation of the leak current dropping from the NPN transistor via the P-type silicon substrate 1 and the isolation region to GND can be prevented.

Figure 1C:
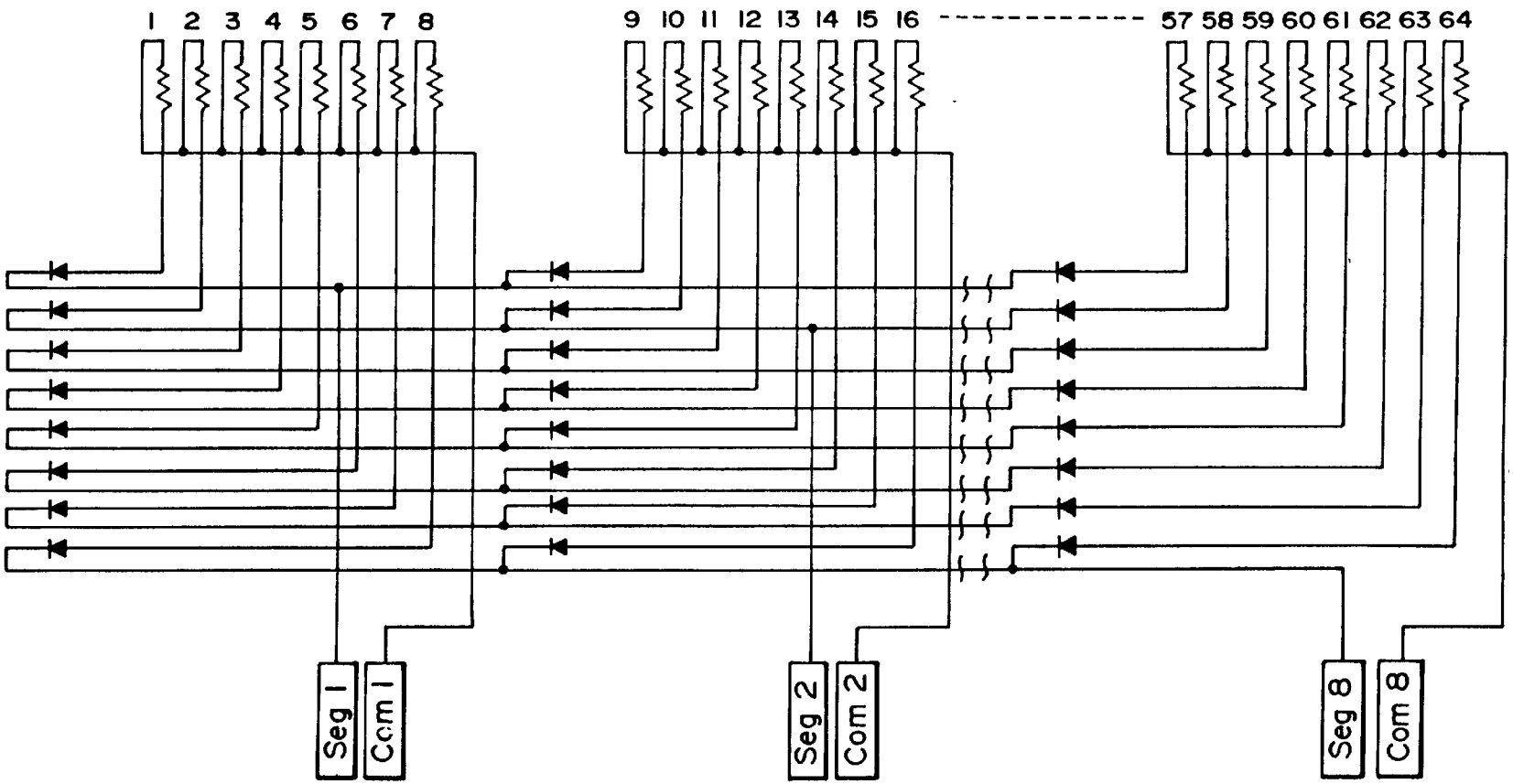

The driving method of the above recording head is described in more detail. In FIG. 1B, only two semiconductor functional devices (cells) are shown, but practically such devices correspond to the electrothermal transducers in the number as shown in FIG. 1C to be arranged in the same number and electrically matrix connected so as to be block drivable (see FIG. 1C). The common electrodes (com1, . . . com8) and selective electrodes (seg1, . . . seg8) are arranged alternately on the substrate.

Here, driving of the electrothermal resistant devices RH1 and RH2 as two segments in the same group is described.

For driving of the electrothermal transducer RH1, first the group is selected by the switch G1 (the common side switch), and also the electrothermal transducer RH1 is selected by the switch S1 (the segment side switch) to apply a positive voltage $V_{H1}$. Then, the diode cell SH1 with a transistor constitution is positively biased, whereby a current flows out from the emitter electrode 13. Thus, the electrothermal transducer RH1 generates heat, which heat energy causes the liquid to undergo a state change and generate bubbles, thereby discharging the liquid through the discharge opening.

Similarly, when the electrothermal transducer RH2 is driven, the switch G1, the switch S2 are selectively turned on to drive the diode cell SH2, thereby supplying a current to the electrothermal transducer.

At this time, the substrate 1 is grounded through the isolation regions 3, 6, 9. Thus, by grounding of the isolation regions 3, 6, 9 of the respective semiconductor devices (cells), erroneous actuations through electrical interference between the respective devices are prevented.

Figure 2A:
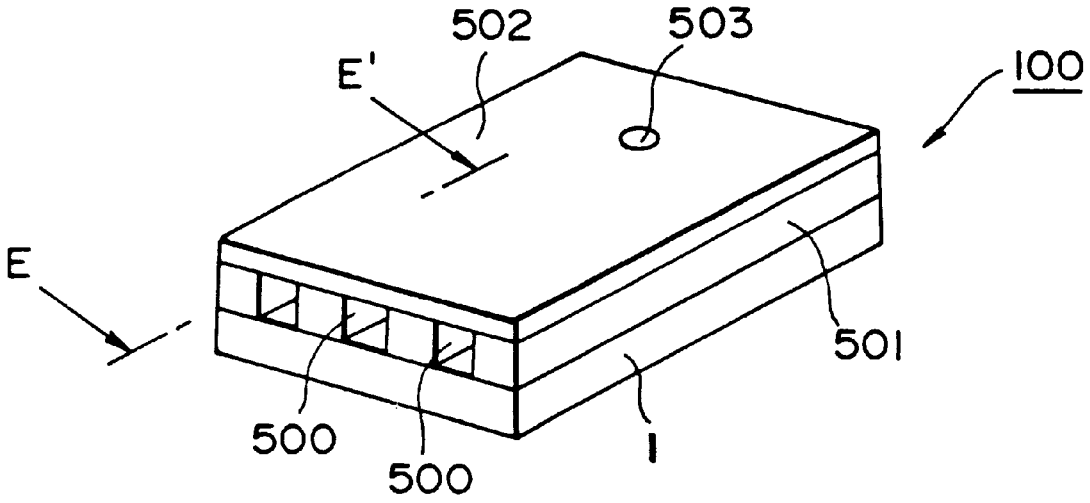
FIGS. 2A and 2B are respectively a perspective view according to an embodiment of the present invention and its sectional view along the line E–E'.

FIG. 2A is a schematic perspective view of a recording head by use of the substrate constituted as outlined above. Such head, as shown in the Figure, has a plurality of discharge openings 500, liquid channel wall members 501 comprising a photosensitive resin, etc. for forming the liquid channels communicated to the discharge openings, ceiling plates 502 and ink supplying openings 503. The liquid wall member 501 and the ceiling plate 502 can be also integrally formed by utilizing a resin mold material.

Next, the substrate and its wiring portion are described in more detail.

Figure 2B:
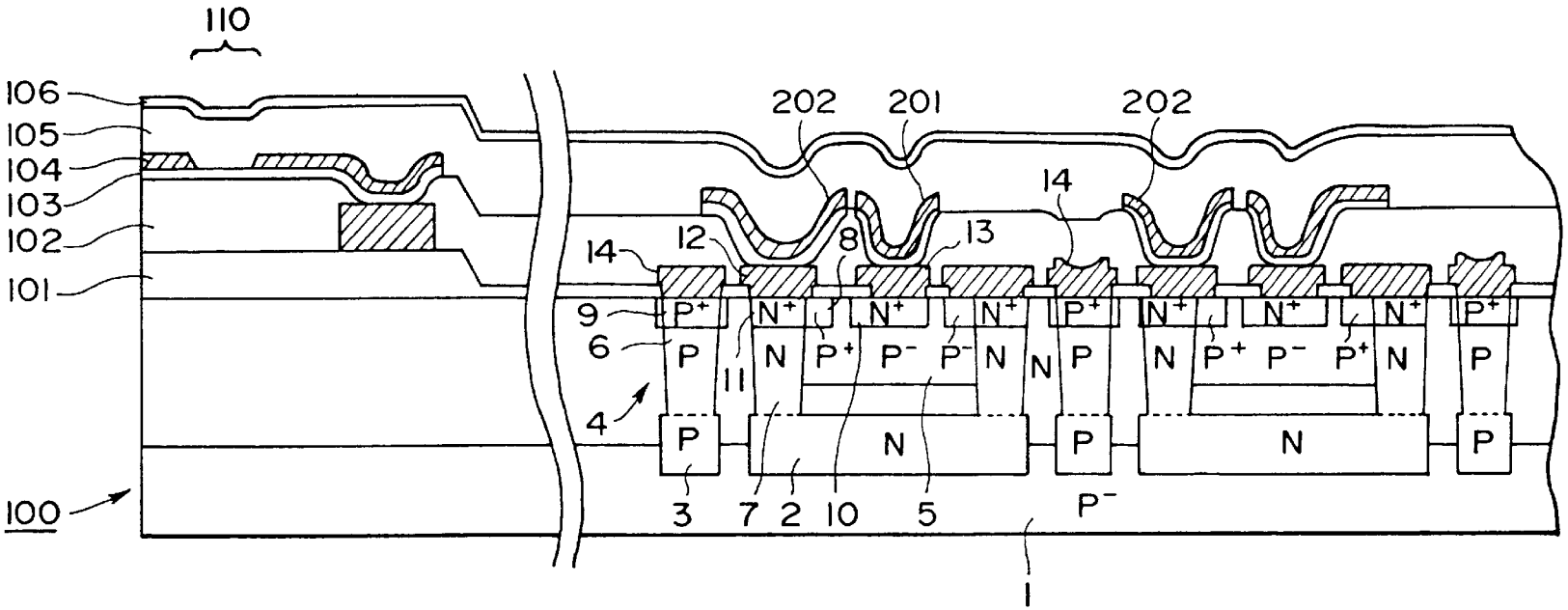

FIG. 2B is a schematic sectional view of the substrate for recording head according to the present embodiment and its wiring portion, namely a sectional view along the line E–E' in FIG. 2A.

In the Figure, 1 is a P-type silicon substrate, 2 an N-type collector embedding region for constituting a functional device, 3 a P-type isolation embedding region for functional device separation, 4 an N-type epitaxial region, 5 a P-type base region for constituting the functional device, 6 a P-type isolation region for device separation, 7 an N-type collector region for constituting the functional device, 8 a high concentration P-type base region for constituting the device, 9 a high concentration P-type isolation region for device separation, 10 an N-type emitter region for constituting the device, 11 a high density N-type collector region for constituting the device, 12 a collector base common electrode, 13 an emitter electrode, and 14 an isolation electrode. Here, NPN transistors SH1, SH2 are formed, and the collector regions 2, 7, 11 are formed so as to surround completely the emitter region 10 and the base regions 5, 8. Also, as the device separation region, the respective cells are surrounded by the P-type isolation embedding region 3, the P-type isolation region 6 and the high concentration P-type isolation region 9 to be electrically separated.

In the recording head 100 of the present embodiment, on the substrate having the driving portion described is provided an $SiO_2$ film 101 by thermal oxidation, and on the heat accumulation layer 102 comprising a silicon oxide film according to the CVD method or the sputtering method, etc. an electrothermal transducer 110 constituted of a heat-generating resistance layer 103 of $HfB_2$, etc. according to the sputtering method and an electrode 104 of Al, etc. Heat-generating resistance layers 103 such as $HfB_2$, etc. are also provided between the collector base common electrode 12 and the emitter electrode 13 and the wirings 202 and 201 such as of Al, etc.

As the heat-generating resistance layer, there may be employed otherwise Pt, Ta, $ZrB_2$, Ti—W, Ni—Cr, Ta—Al, Ta—Si, Ta—Mo, Ta—W, Ta—Cu, Ta—Ni, Ta—Ni—Al, Ta—Mo—Ni, Ta—W—Ni, Ta—Si—Al, Ta—W—Al—Ni, Ti—Si, W, Ti, Ti—N, Mo, Mo—Si, W—Si, etc. Further, on the heat-generating portion 110 of the electrothermal transducer are provided a protective layer 105 such as $SiO_2$, etc. according to sputtering or the CVD method and a protective film 106 such as Ta, etc.

Here, the $SiO_2$ film forming the heat accumulation layer 102 is provided integrally with the interlayer insulating film between the lowest layer wirings 12, 14 and 201 and 202 as the intermediate wirings.

As for the protective layer 105, it is also similarly integrated with the interlayer insulating film between the wirings 201 and 202.

Next, by referring to FIGS. 3A–3K, the preparation steps of the recording head according to the present embodiment are described.

(1) On the surface of a P-type silicon substrate 1 with an impurity concentration of about $1\times10^{12}$ to $10^{16}$ $cm^{-3}$ a silicon oxide film with a thickness of about 5000 to 20000 Å is provided.

The silicon oxide film at the portion where the collector embedding regions 2 of the respective cells was removed by the photolithographic step.

An N-type impurity, for example, P, As, etc. was injected, and by thermal diffusion an N-type collector embedding region 2 with an impurity concentration of $1\times10^{19}$ $cm^{-3}$ or more was formed to a thickness of 10 to 20 $\mu$m. At this time, the sheet resistance was made 30 Ω/□ or less.

Figure 3A:
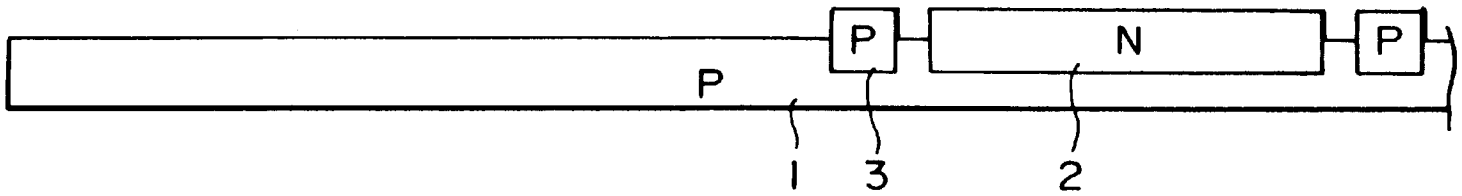
FIGS. 3A to 3K are schematic sectional views for illustration of the process for preparing the recording head according to the present embodiment.

Subsequently, the oxide film where the P-type isolation embedding region 3 is to be formed was removed to form a silicon film with a thickness of about 100 to 3000 Å, and then the P-type impurity, for example, B, etc. was ion injected and by thermal diffusion, a P-type isolation embedding region 3 with an impurity concentration of $1\times10^{17}$ to $10^{19}$ $cm^{-3}$ was formed (see FIG. 3A).

Figure 3B:
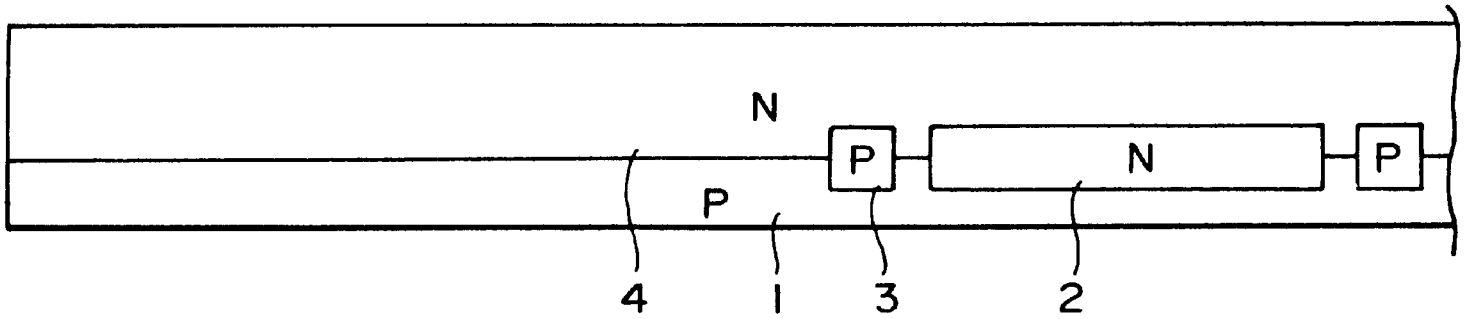
Figure 3C:
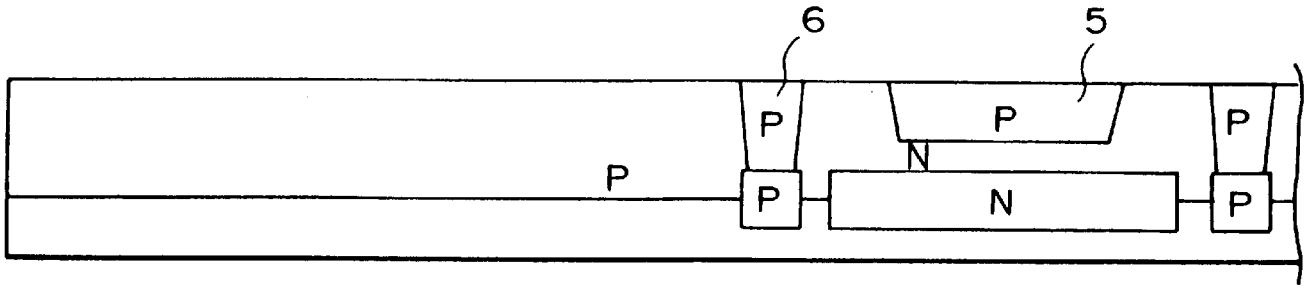
Figure 3D:
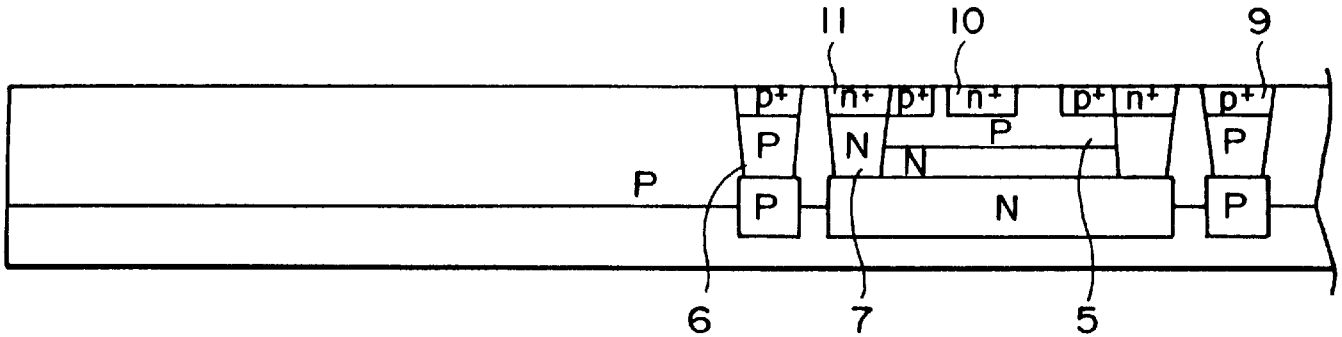
Figure 3E:
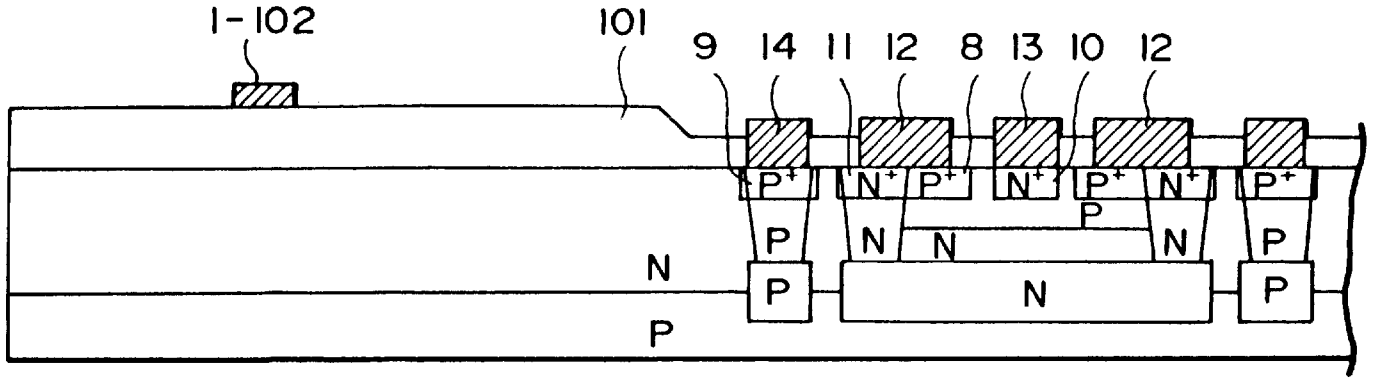

(2) After removal of the oxide film on the whole surface, an N-type epitaxial region 4 with an impurity concentration of about $1\times10^{12}$ to $10^{16}$ $cm^{-3}$ was epitaxially grown to a thickness of about 5 to 20 $\mu$m (see FIG. 3B).

(3) Next, on the N-type epitaxial region surface was formed a silicon oxide film of about 100 to 300 Å, a resist was coated, the oxide film was subjected to patterning and ions of the P-type impurity were injected only into the region where the low concentration base region 5 is to be formed. After removal of the resist, by thermal diffusion, the low concentration P-type base region 5 with an impurity concentration of $5\times10^{14}$–$5\times10^{17}$ $cm^{-3}$ was formed to a thickness of 5 to 10 $\mu$m.

Again the oxide film was removed from the whole surface, and after formation of a silicon oxide film with a thickness of about 1000 to 10000 Å, the oxide film in the region where the P-type isolation region 6 is to be formed was removed, followed by deposition of a borosilicate glass (BSG) film on the whole surface by use of the CVD method. Further, by thermal diffusion the P-type isolation region 6 with an impurity concentration of $1\times10^{18}$ to $10^{20}$ $cm^{-3}$ was formed to a thickness of about 10 $\mu$m so as to reach the P-type isolation region 3 (see FIG. 3C).

Here, it is also possible to form $BBr_3$ as the diffusion source.

(4) After removal of the BSG film, a silicon oxide film with a thickness of about 1000 to 10000 Å was formed, and further after removal of the oxide film only in the region where the N-type collector region 7 is to be formed, an N-type impurity such as phosphorus is thermally diffused or $P^+$ ions are injected, and by thermal diffusion the N-type collector region 7 was formed so as to reach the collector embedding region 5. The sheet resistance at this time was made a low resistance of 10 Ω/□ or lower. The thickness of the region 7 was made about 10 $\mu$m, and the impurity concentration $1\times10^{18}$ to $10^{20}$ $cm^{-3}$.

Subsequently, after removal of the oxide film in the cell region, a silicon oxide film of 100 to 300 Å was formed, and the oxide film was subjected to patterning by use of a resist, followed by ion injection of a P-type impurity only into the region where the high concentration base region 8 and the high concentration isolation region 9 are to be formed. After removal of the resist, the oxide film in the region where the N-type emitter region 10 and the high concentration N-type collector region 11 are to be formed was removed, and a PSG film was formed on the whole surface, followed by injection of $N^+$. Then, by thermal diffusion, the high concentration P-type base region 8, the high concentration P-type isolation region 9, the N-type emitter region 10, the high concentration N-type collector region 11 were formed at the same time. The thickness of each region was made 1.0 $\mu$m or less and the impurity concentration $1\times10^{19}$ to $10^{20}$ $cm^{-3}$ (see FIG. 3D).

(5) Further, after formation of the silicon oxide film 101, the silicon oxide film at the connecting portion was removed and Al, etc. except for the electrode region was removed to form electrodes 12, 13. At this time, through the isolation region 9, the wiring 14 to be electrically connected to the substrate 1 was also formed. Also, the common wiring 1-102, the segment longitudinal wiring 1-110, and the segment take-out wiring 1-105 were formed at predetermined sites (see FIG. 3E).

(6) According to the sputtering method, the $SiO_2$ film 102 which becomes the heat accumulation layer and the interlayer insulating film was formed on the whole surface to a thickness of about 0.4 to 1.0 $\mu$m. The $SiO_2$ film may be also formed according to the CVD method.

Figure 3F:
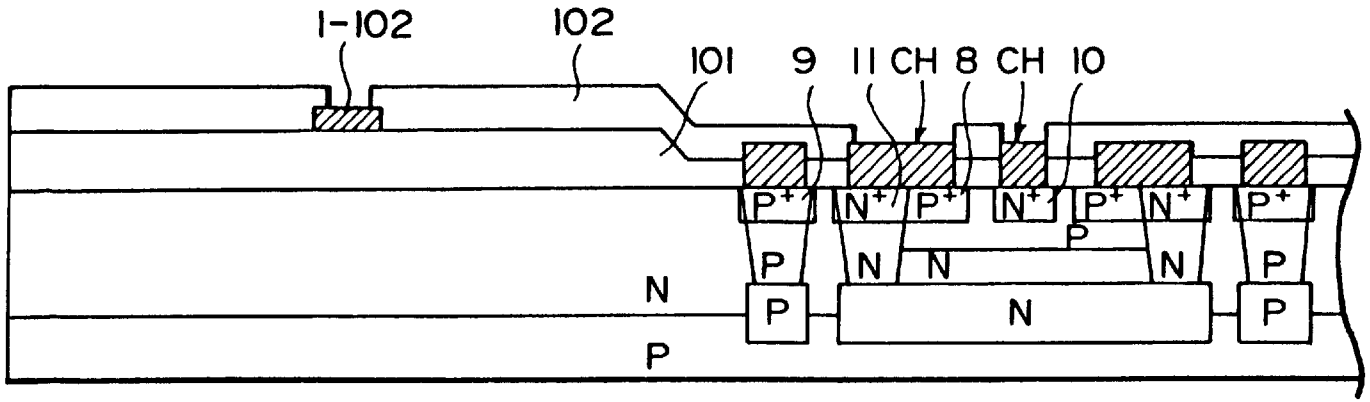

Next, for taking electrical connection, the predetermined wiring portions (1-102, etc.), the emitter region and a part of the insulating film corresponding to the upper part of the base-collector region CH were opened by the photolithographic method (see FIG. 3F).

Figure 3G:
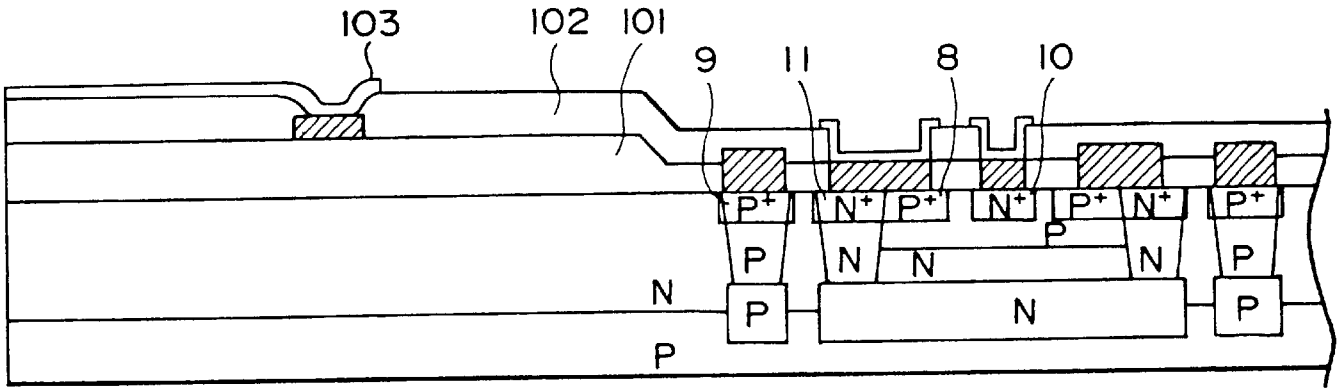

(7) Next $HfB_2$ as the heat-generating resistance layer 103 was formed on the $SiO_2$ film 102, and for taking electrical connection, on the electrode at the upper part of the emitter region and the electrode at the upper part of the base-collector region, and further deposited on the predetermined wiring portions to a thickness of about 1000 Å, followed by patterning (see FIG. 3G).

Figure 3H:
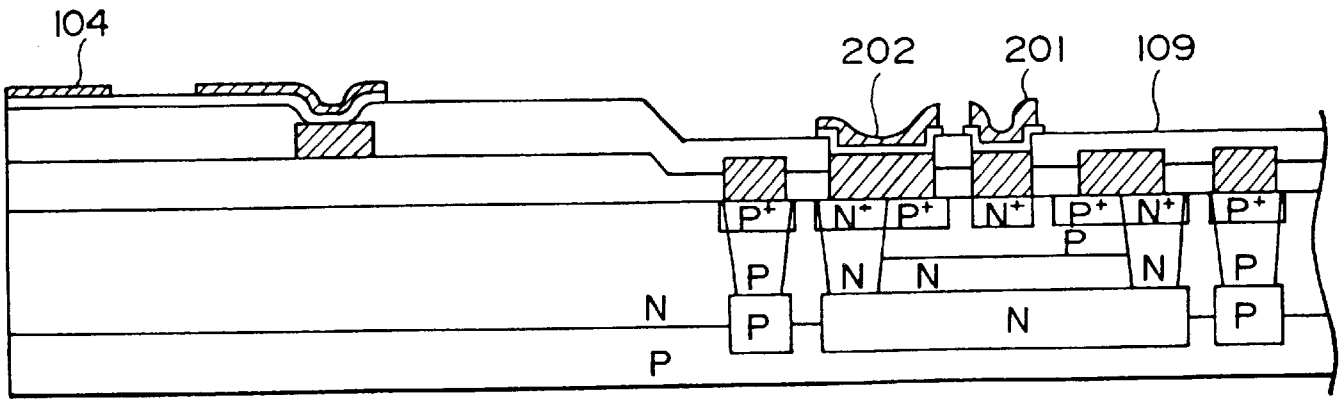

(8) On the patterned layer were deposited a pair of electrodes 104 of the electrothermal transducer, the cathode electrode wiring 201 and a layer comprising an Al material as the electrode wiring 202, followed by patterning, to form the electrothermal transducer and other wirings at the same time (see FIG. 3H).

Here, between the heat-generating resistance layer 103 and the Al electrodes 12, 13, 14 which are lower layers and/or between the heat-generating resistance layer 103 and the Al electrodes 104, 201 and 202 which are upper layers, it is desirable to interpose Ti as the layer for improving adhesion between $HfB_2$ and Al. For example, when Ti is interposed between the former, after formation of the thru-hole for the Al electrode of the lower layer, Ti may be deposited to a thickness of 30 to 40 Å according to the sputtering method $HfB_2$ deposited thereon, further Al 201, 202 of the upper layers deposited thereon, and then Al subjected to patterning by wet etching, followed by patterning of Ti and $HfB_2$ by dry etching.

Figure 3I:
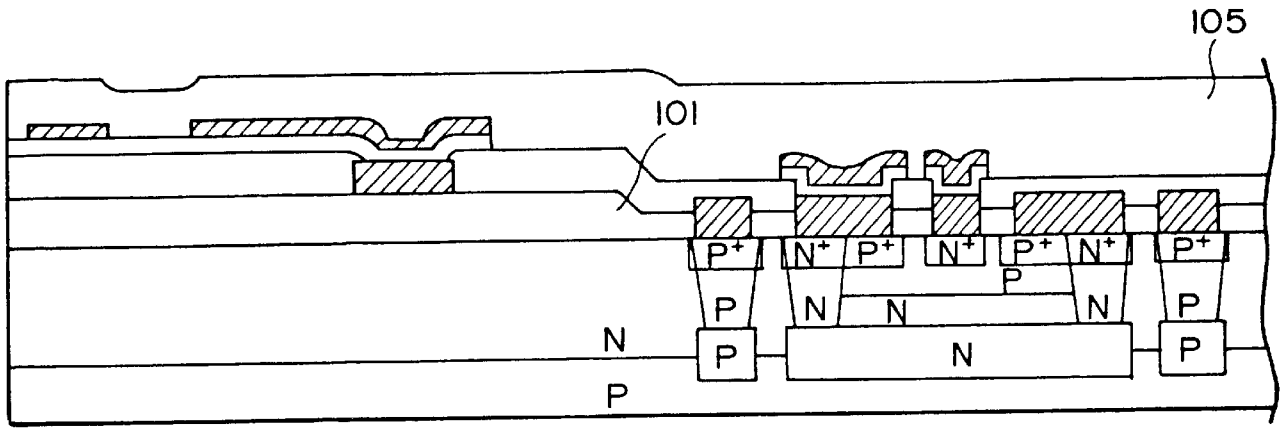

(9) Then, the $SiO_2$ film 105 as the protective layer of the electrothermal transducer was deposited according to the sputtering method (FIG. 3I).

Figure 3J:
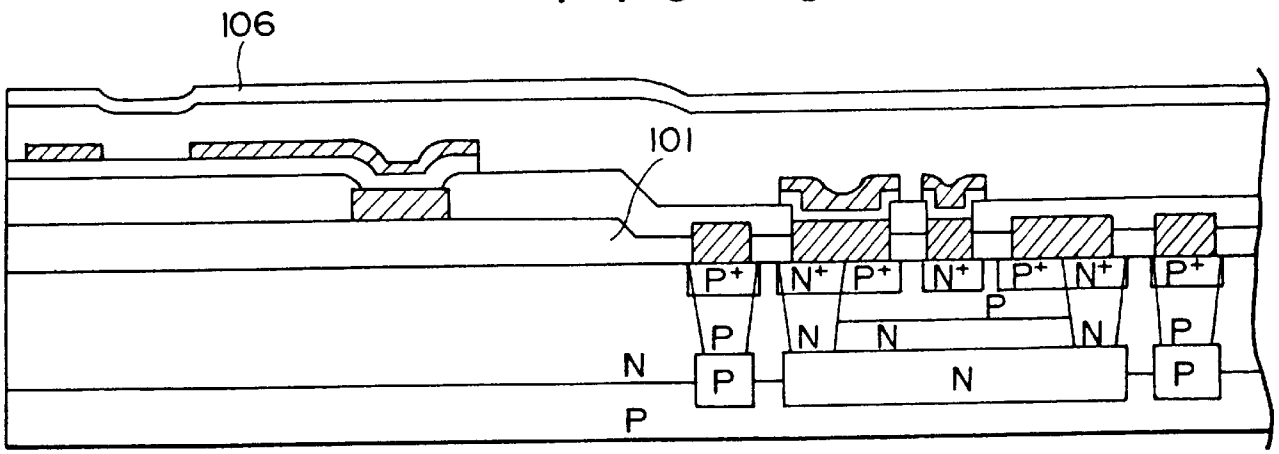

(10) On the upper part of the heat-generating portion of the electrothermal transducer, Ta was deposited as the protective layer 106 for cavitation resistance to a thickness of 2000 Å (FIG. 3J).

Figure 3K:
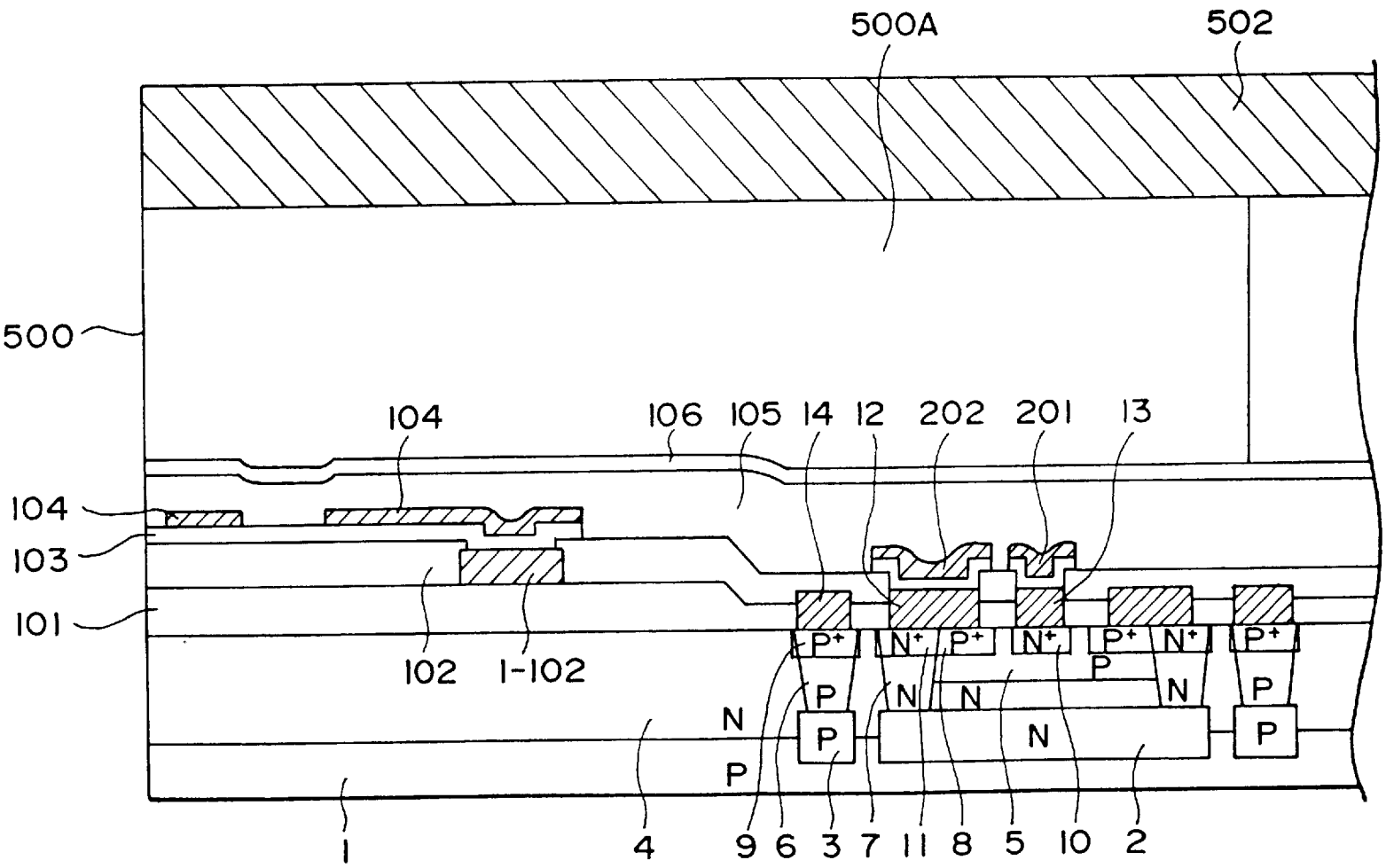

(11) On the substrate having the electrothermal transducer, the semiconductor device prepared as described above, a liquid channel wall member and a ceiling plate 502 were arranged to form an ink channel 500A communicated to the discharge opening 500, thereby preparing the recording head (FIG. 3K).

For such recording head, recording, actuation tests were conducted by block driving the electrothermal transducer. In the actuation test, eight semiconductors were connected to one segment and currents each of 300 mA (total 2.4 A) were permitted to flow, and other semiconductor diodes could perform good discharging without erroneous actuation.

Figure 4A:
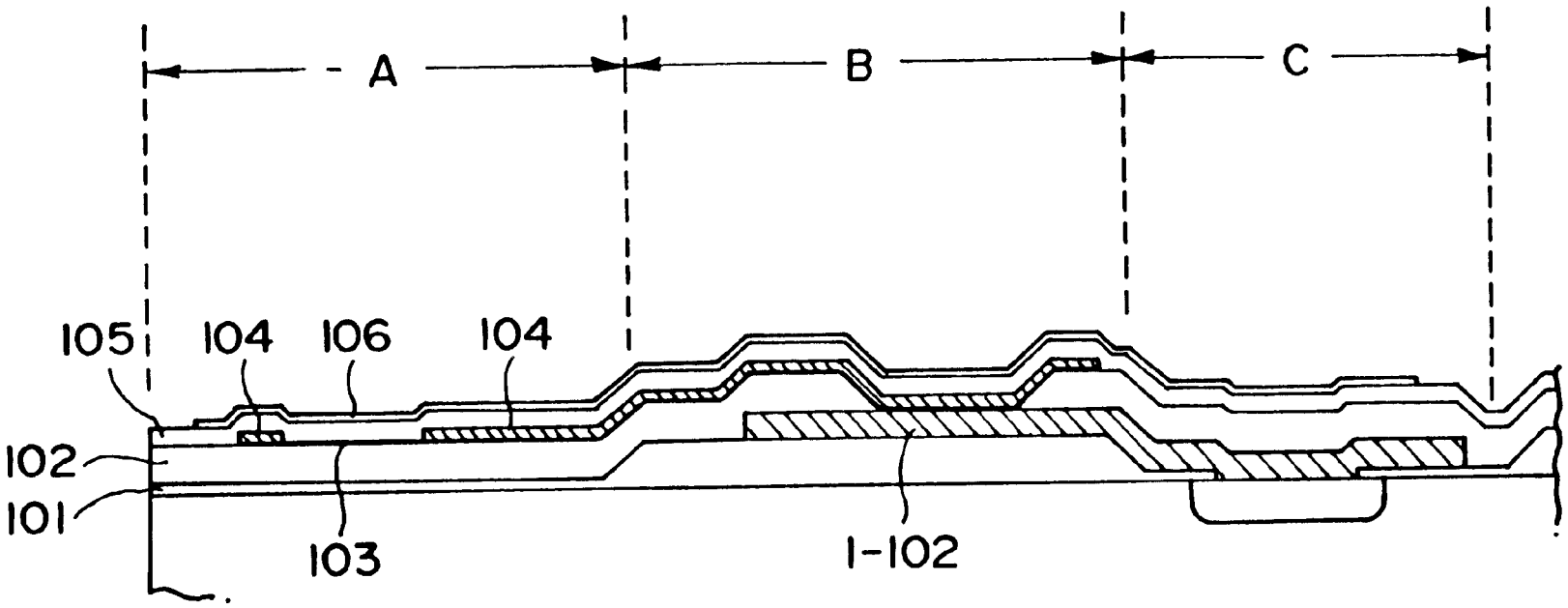
FIGS. 4A to 4D are respectively schematic views for illustration of other embodiments of the present invention.

FIG. 4A is a sectional view of the substrate according to the second embodiment of the present invention. The heater board 100*a* according to the present embodiment may be considered as classified broadly into the three areas A, B, C. A is the electrothermal transducer portion, B the wiring portion, C the diode portion, and the heat accumulation layer 101 is varied in thickness so as to be adapted to the respective areas. In the electrothermal transducer portion A, for the balance with the thickness of the protective layer 105, the thickness is made about 1.5 to 2.0 $\mu$m in conformity with the heat accumulation layer 102. At the wiring portion B, for improvement of insulation with the Si substrate, the thickness is made thick, and the at the diode portion C, the thickness is made about 0.3 $\mu$m in view of contact with the first layer wiring 1-102. The thickness of the first layer wiring 1-102 has great influence on the wiring resistance of the segment, and therefore made thick up to 0.9 to 1.4 $\mu$m to the extent which does not exceed the thickness of the heat accumulation layer 102 of about 1.0 to 1.5 $\mu$m. The second layer wiring 104 has small influence on the wiring resistance, and therefore is made as thin as possible (about 0.3$\mu$), whereby the thickness of the protective layer 105 becomes thinner to about 0.4 to 0.6 $\mu$m to improve thermal efficiency to a great extent. The protective layer 102, in view of the respective layers 104, 105, 106, may be subjected to patterning so that the step difference portion becomes tapered, or the film formation method in which the step difference becomes tapered such as the bias sputtering method may be employed. The planer arrangement constitutions of the devices and the wirings are the same as described above in FIG. 1A.

The wiring resistance has already become smaller in the film constitution of the prior art example, but by taking the constitution of the present embodiment, liberation from the restriction of the antinomy of the prior art is possible, and by varying the film thickness further reduction of wiring resistance and improvement of heat transmission efficiency can be accomplished.

Whereas, the wiring can make danger such as short circuit of bridge, etc. or wiring smaller if it is shaped singly so far as possible.

Figure 4B:
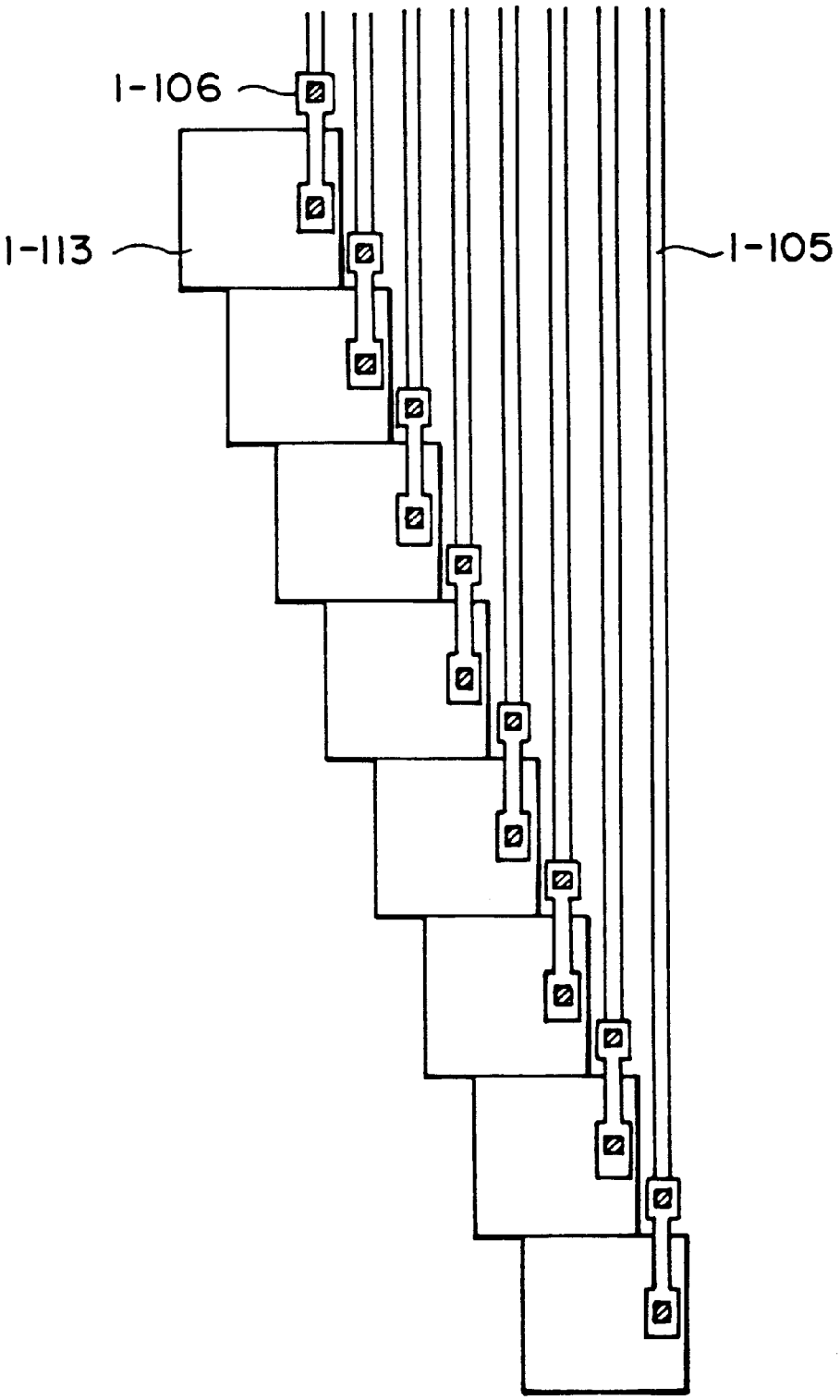

FIG. 4B shows an embodiment in which the diode arrangement is made as slipped obliquely depending on the pitch of the segment take-out wiring 1-105 in arranging the diodes 113 in the longitudinal direction for the embodiment in FIG. 1A. By doing so, the take-out wiring 1-105 becomes linear, whereby the design can be simplified, the wiring resistance reduced and the degree of freedom of the layers upon this improved. In this case, the anode electrode of 1-106 is performed by the first layer wiring.

In the prior art, segment electrodes were arranged on the both side portions of the substrate, and therefore the substrates could not be combined to be made lengthy. In contrast, in the present invention, the arrangement as described below becomes possible.

Figure 4C:
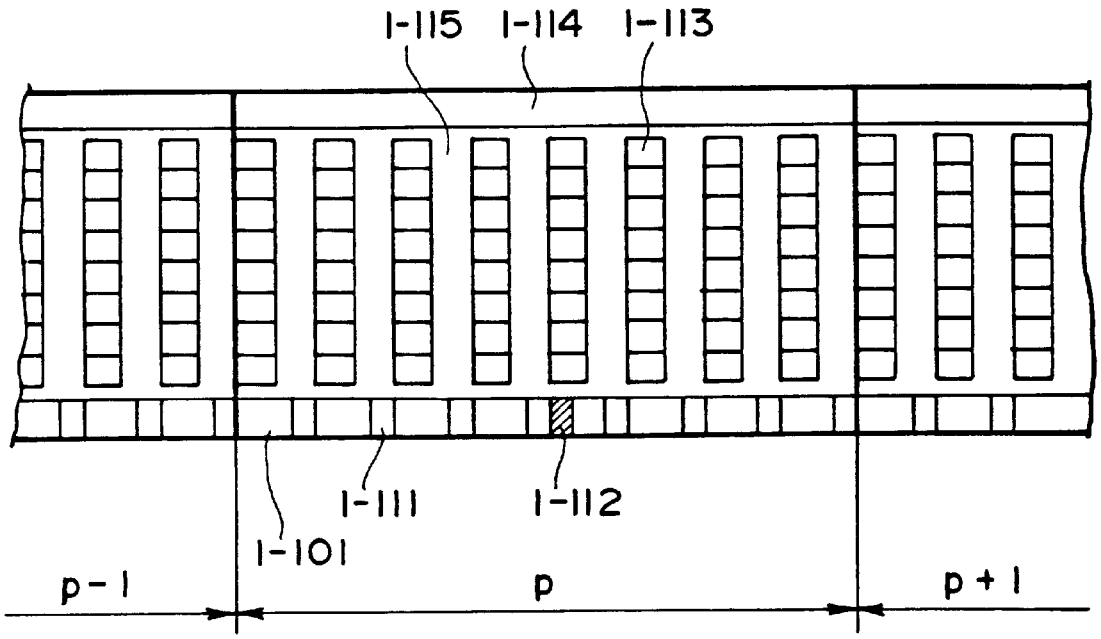

In FIG. 4C, heater boards with a heater board having a matrix structure of 8×8 and 64 heaters as one unit are continuously arranged. In the heater row area 1-114, heaters are arranged with the same pitches as the p−1th unit and the p+1th unit. The common electrode 1-101 and the segment electrode 1-111 are juxtaposed alternately, and at the center of the unit is arranged the isolation electrode 1-112.

When the heater number r is made the matrix, the case when m=n in r=m (common side)×n (segment side) is advantageous on the driving side, but since the segment take-out length becomes longer as r is increased, m is taken larger and n smaller. In that case, the structure of the present embodiment is very advantageous. At this time, the resistance difference in segment lateral wiring becomes larger, but there is no problem because the constitution can have a plurality of segment longitudinal wiring per one segment lateral wiring.

When the constitution as in the embodiment described above is employed concerning the heater board, the segment electrode will not come out, and therefore a plural arrangement of substrates in number of p is also possible with the constitution of m×n matrix as one unit as in the present embodiment.

Figure 4D:
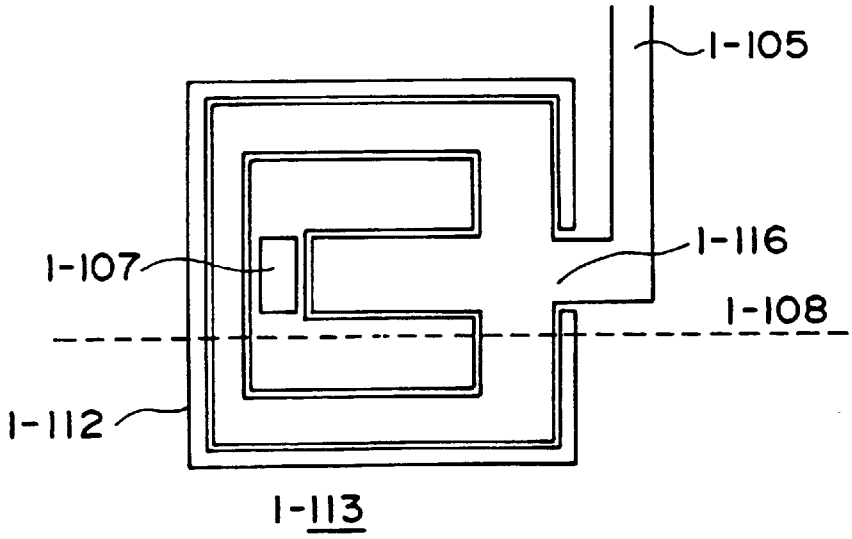

FIG. 4D shows an embodiment of the diode 1-113. In FIG. 1A, for description of the basic constitution of the present invention, when connecting to the segment take-out wiring, the shape such as the anode electrode 1-106 shown was taken with the second layer wiring, whereby the segment lateral wiring 1-108 became greater in wiring resistance in order to circumvent this portion. Accordingly, as shown in FIG. 4D, an opening is provided at the isolation electrode so as to surround the diode to form an anode take-out wiring 1-116, whereby connection to the segment lateral wiring 1-105 is possible with the first layer wiring, while the segment lateral wiring 1-108 of the second layer wiring can be subjected to wiring without any restriction, whereby no increase in wiring resistance will occur. Thus, taking out of the electrode as in the present embodiment will make the present invention more effective.

Figure 5A:
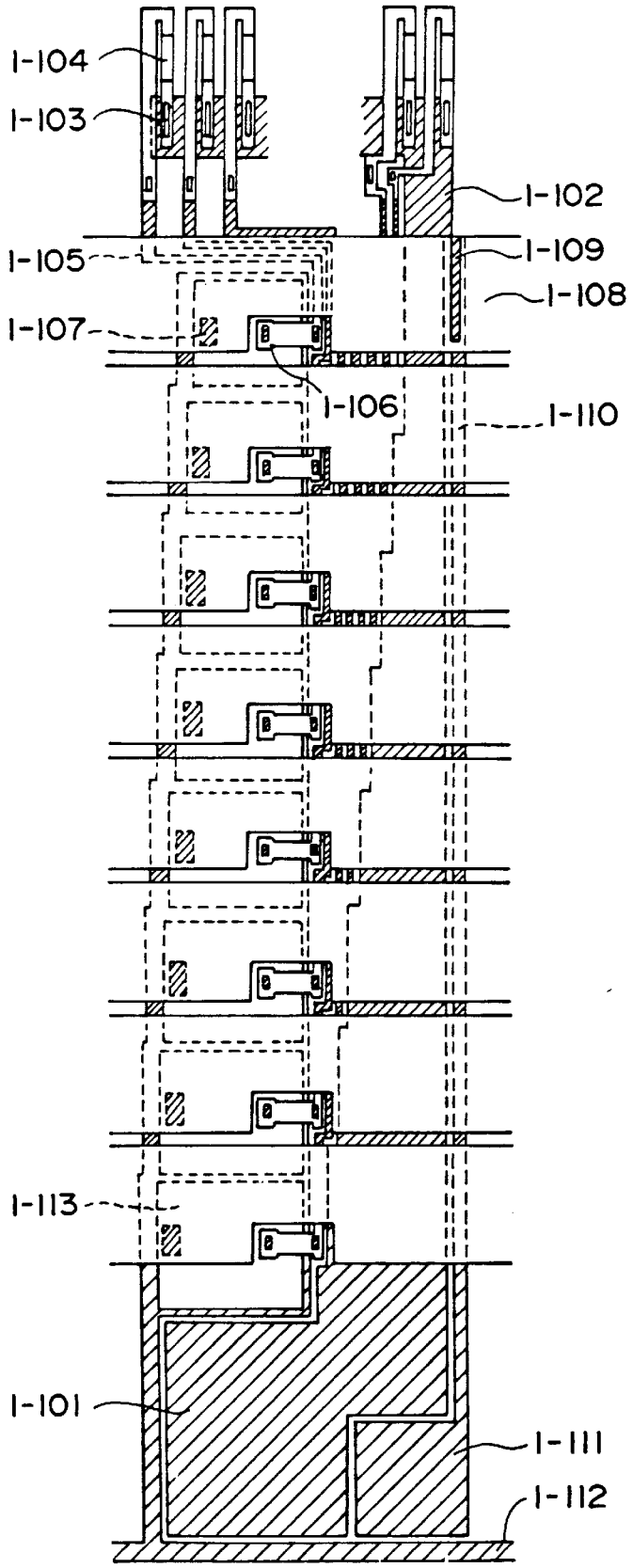
FIG. 5A is a schematic plan view showing the substrate for recording head according to another embodiment.

FIG. 5A shows a wiring arrangement embodiment on the substrate (silicon substrate) of an ink jet recording device according to another embodiment of the present invention. Here, the wiring comprises a first layer wiring which becomes the lower layer wiring, a second layer wiring which becomes the upper layer wiring, and a thruhole for connecting electrically these.

In FIG. 5A, 1-101 is the common electrode with the first layer wiring, and connected to the common wiring 1-102. The common wiring 1-102 is connected to one of the electrothermal transducers 1-104 juxtaposed laterally in an array through a thruhole via the take-out wiring on the 1-105 common side with the first layer wiring.

The electrothermal transducer 1-104 is formed of a heat generating resistance layer and the second layer wiring, and via the segment side take-out wiring 1-105 of the first layer wiring, is connected to the anode electrode 1-106 of the diode 1-113 used as the functional device for driving the electrothermal transducer through the thruhole, the second layer wiring, and via the thruhole through the anode electrode 1-106. The cathode electrode 1-107 of the diode is connected to the segment lateral wiring 1-108 with the second layer wiring through the thruhole. The segment lateral wiring is connected via the thruhole 1-109 to the segment longitudinal wiring 1-110 with the first layer wiring, and the segment longitudinal wiring to the segment electrode 1-111.

In the present Figure, one with the number of electrothermal transducers within one block being made 8 segments is shown by way of example, particularly those at the both ends. Here, 8 diodes utilized as the functional device are juxtaposed in the longitudinal direction in FIG. 5A along the arrangement direction of the segment lateral wiring. When the diodes thus juxtaposed are actuated, for prevention of erroneous actuation of adjoining mutual diodes, the isolation electrode 1-112 for diode is arranged around the diodes to form an isolation region.

As shown in FIG. 5A, in the present embodiment, the diode 1-113 is smaller in size as nearer to the heater 1-104.

By use of FIG. 5B, the functional description of the means for correcting the thermal influence by changing the diode size is given based on the temperature distribution of the heater board and the temperature characteristics of the diode.

In the Figure, the heater board 122 is shown with FIG. 5A being omitted, and equipped with the heater row 124 and the diode row 123. The heater board 120 is an example in which the individual diode sizes within the diode 121 are made uniform. The temperature distribution on A–A' of the heater board 120 is shown in the graph <I>, and now when the heater is heated, it can be understood that the heater row 124 portion becomes the maximum temperature, and the temperature is lower as departed from that portion. Here, $\Delta T_D$ is made the maximum temperature gradient when the heater is heated highest, $T_{D1}$, $T_{D4}$, $T_{D8}$ the maximum temperature differences at the positions of the diodes $D_1$, $D_4$, $D_8$, respectively, namely the temperature differences between when the heater is not heated and when the heater is heated highest. For convenience, three points of the positions of the diodes have been picked up, but the same principle is also applicable to description of $D_2$, $D_3$, $D_5$, $D_6$, $D_7$.

Figure 5C:
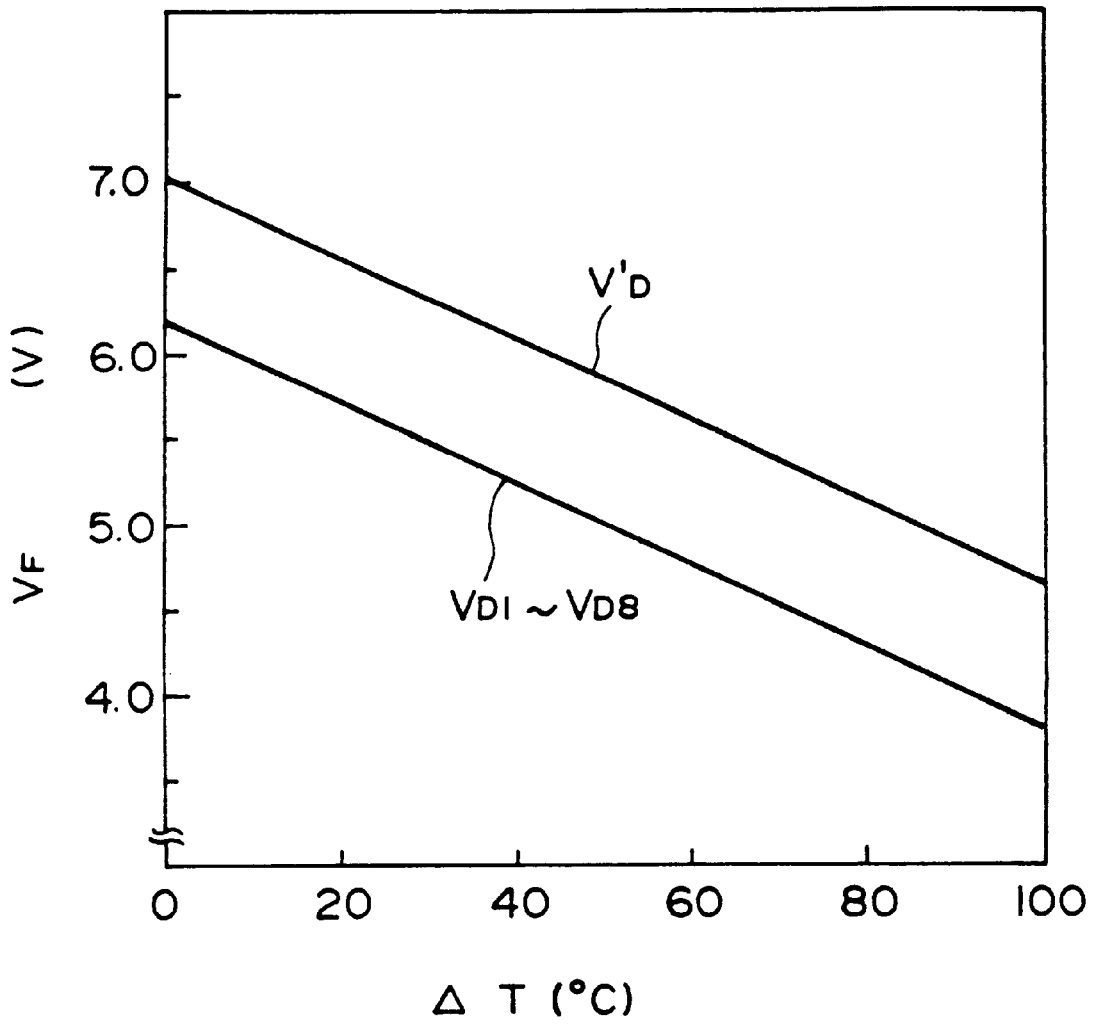

Next, the normal direction saturated voltages $V_F$ of the diodes $D_1$ to $D_8$ are shown in FIG. 5C.

It can be understood that the diode has smaller $V_F$ as the temperature is higher. This is applied to the graph <II> in FIG. 5B, in which the axis of ordinate $\Delta T$ is set to be of the same scale as in the graph <I>.

Now, when the heater 124 is not heated and $\Delta T=0$, $V_{D1}$ to $V_{D8}$ have $V_F=V_o$, but when the heater board 120 becomes to have temperature gradient $\Delta T_D$, the temperature at the diode $D_1$ becomes $T_{D1}$, and therefore $V_F$ of the diode $D_1$ becomes $V_1$. That of the diode $D_8$ is $V_8$, whereby a $V_F$ difference $\Delta V_{1\text{-}8}$ occurs between the diodes $D_1$ and $D_8$.

Next, the temperature characteristics of $V_F$ of the diodes $D_1'$, $D_4'$, $D_8'$ of the diode row 123 on the heater board 122 are described by referring to the graph <III>. The characteristics of the diodes $D_1$, $D_4$, $D_8$ become respectively $V_{D1}'$, $V_{D4}'$, $V_{D8}'$, which characteristics are made different by varying the diode size utilizing the fact that the voltage drop with the diode becomes greater as the diode size is smaller to increase $V_F$. The diode size may be chosen in the manner so that the diodes $D_1$, $D_4$, $D_8$ may be equal in $V_F$ at ½ of the heater board maximum temperature gradient $\Delta TD$, namely $T_{D1}/2$, $T_{D4}/2$, $T_{D8}/2$. $V_F$ at this time is defined as $V_o'$, and corresponding to $V_o$ in the graph <III>, the actuation points are determined for these in the graph. Now, when the heater board 122 is heated to create a temperature gradient of $\Delta TD$, the $V_F$'s of the diodes $D_1$, $D_4$, $D_8$ becomes respectively $V_1''$, $V_4''$, $V_8''$ from the graph <III>, with the $V_F$ difference between the diodes $D_1$ and $D_8$ being $\Delta V_{1\text{-}8}'$.

Here, by comparison between the graph <II> and the graph <III>, it can be understood from the present embodiment that the temperature influence of the diode is ½. More specifically.

$$\frac{\Delta V_{1-8}}{2} = \Delta V'_{1-8} = \Delta V''_{1-8}$$

This is determined from the following formulae:

$$\frac{V_1}{2} = V_1' = V_1'', \quad \frac{V_4}{2} = V_4' = V_4'', \quad \frac{V_8}{2} = V_8' = V_8''$$

Thus, by movement of the actuation point $V_o$ of the diode $V_F$ to $V_o'$, dependency of the diode $V_F$ on the heater board temperature gradient can be suppressed to ½.

Next, actuation of the ink jet recording device according to the present invention is described.

For actuation of the resistor 1-104 in the desired electrothermal transducer, the common electrode 1-101 and the segment electrode 1-111 are chosen. The pulse for driving through the common electrode 1-101 to the common wiring 1-102, the common side take-out wiring 1-103, the electrothermal transducer 104, and further through the segment side take-out wiring 1-105 to the anode electrode 1-106 of the diode. Further, passing through the diode, from the diode cathode electrode 107, the pulse passes through the segment lateral wiring 108, through the thruhole 1-109 and through the segment longitudinal wiring 1-110, and via the segment electrode 1-111 to the outside. Because a diode structure is constituted on a P-type silicon substrate for prevention of the diode erroneous actuation at this time, the isolation electrode 1-112 is ground. Here, a driving pulse is applied to the electrothermal transducer, whereby the resistor generates heat to heat the ink immediately thereon to effect foaming, thereby forming discharge ink droplets.

Figure 5D:
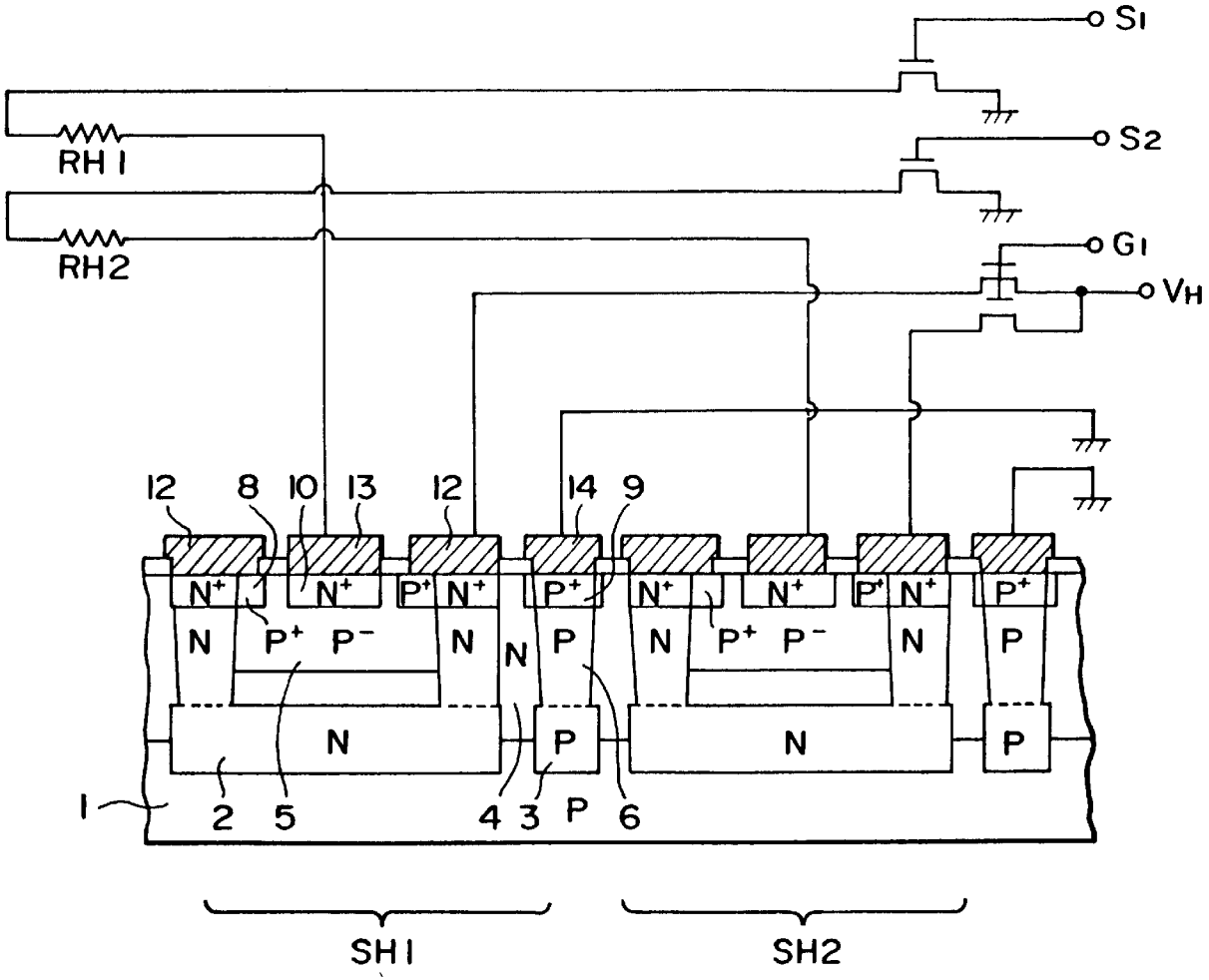
FIG. 5D is a sectional view schematically shown of the wiring portion f the substrate according to still another embodiment of the present invention.

Here, connection of the electrothermal transducer with the diode as the functional device for driving thereof, driving of the electrothermal transducer, etc. are substantially the same as in the first embodiment described above about the preparation steps of the ink jet recording head. The constitution of the wiring portion may be also as shown in FIG. 5D. More specifically, in FIG. 5D, a positive bias voltage VH1 is applied on the collector-base electrode 12, and the current from the emitter electrode 13 flows to the electrothermal transducer RH1 or RH2.

For such recording head, recording, actuation tests were conducted by block driving the electrothermal transducer. In the actuation tests, 8 semiconductor diodes were connected to one segment, and a current of 300 mA (total 2.4 A) was permitted to flow to each diode, and other semiconductors could perform good discharging without erroneous actuation.

FIG. 6A shows one utilizing different characteristics of the diodes $D_1$–$D_8$ in FIG. 5B.

In the present embodiment, temperature correction was made by designing the diodes so as to have different temperature dependencies, and a diode having the characteristics of $V_{D1}$ in the graph <II> with small temperature dependency is placed at D1 nearest to the heater row 124, a diode with higher temperature dependency placed as remote from the heater row 124, until a diode having the characteristic of $V_{D8}$ is employed as $D_8$.

Now, similarly as in FIG. 5B, as shown in the graph <I> in FIG. 6A, by use of the diodes corresponding to the diode positions as in the graph <II> relative to the temperature gradient occurring on the heater board, the respective diodes $V_F$ will become the constant $V_F$, giving rise to no difference in $V_F$. Here, the gradient design of the diode $V_F$ can be made as follows.

$$V_F=(kT/q)1n(I_F/I_S)$$

$$I_S=qs[D_P P_n/L_P)+(D_n n_P)/L_n]$$

Here, k, q are constants, T is temperature, $I_F$ current, $D_P$, $D_n$ are diffusion constants, $n_P$, $P_n$ are small number carrier densities, $L_P$, $L_n$ are distances to the points where the carrier density becomes 1/e.

More specifically, in the semiconductor process, the diodes $D_1$–$D_8$ may be passed through the diffusion step as required, respectively.

Figure 6B:
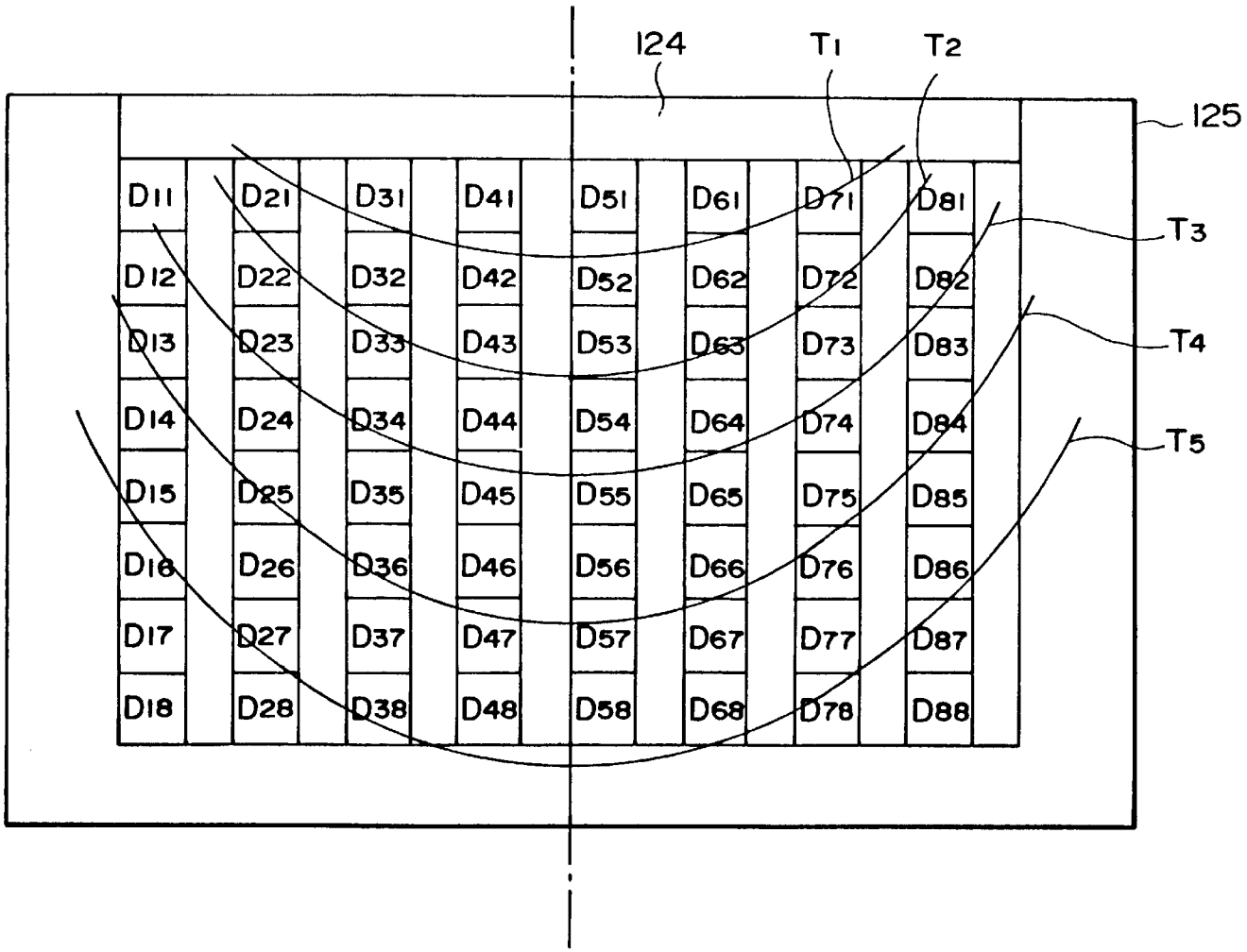
Figure 7:
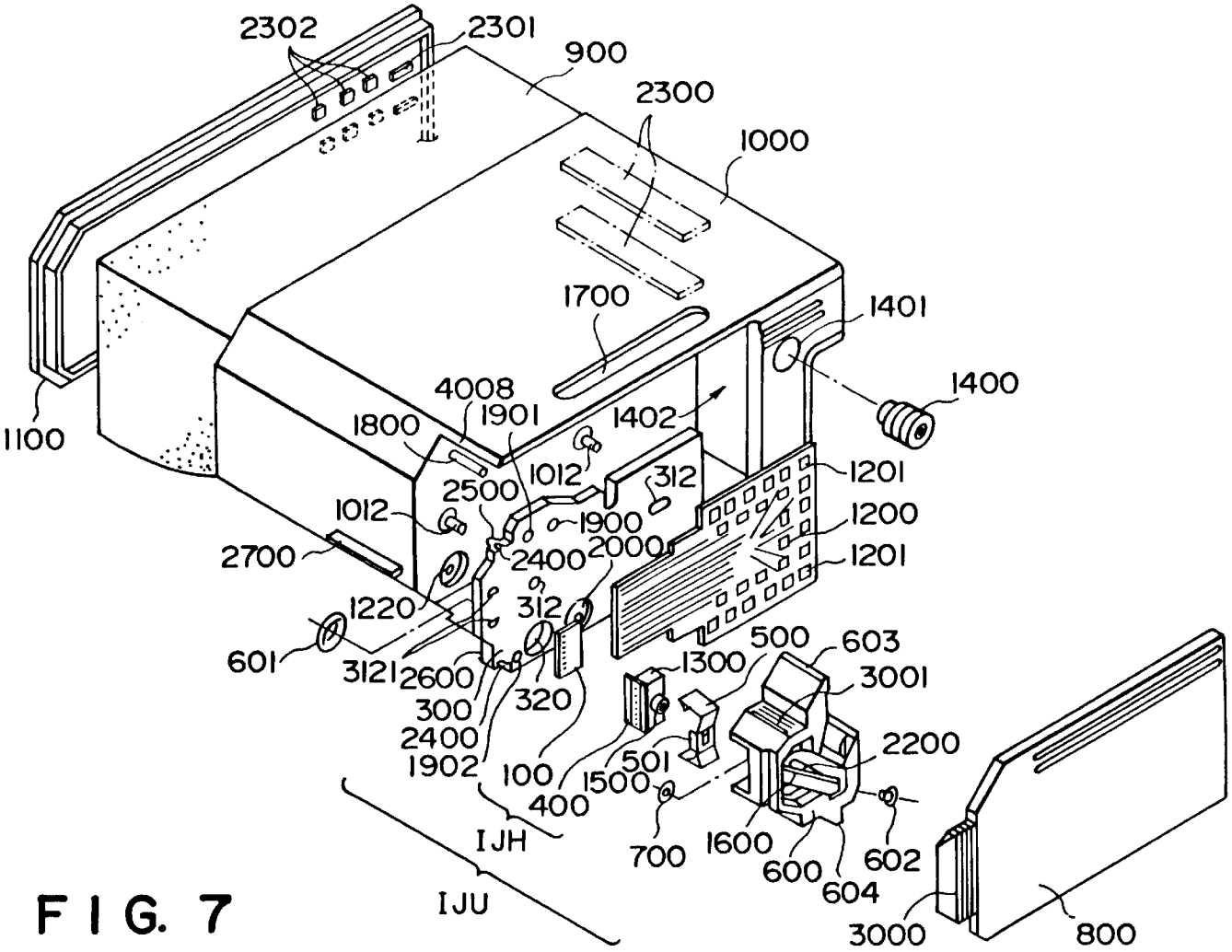
FIG. 7 is an exploded constitutional perspective view of a cartridge constitutable by application of the recording head according to the present invention.
Figure 8:
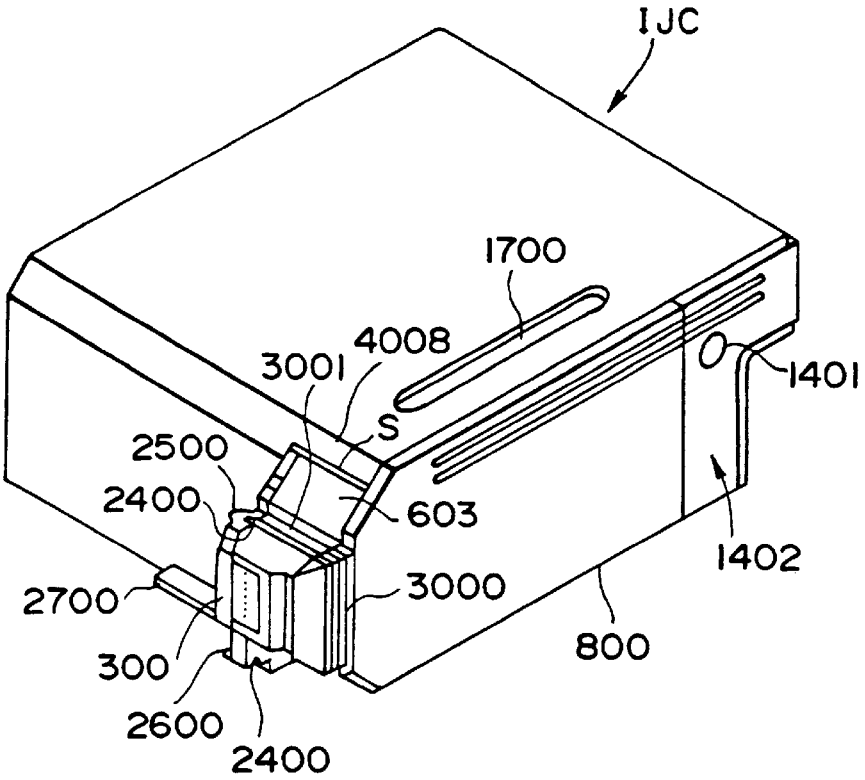
FIG. 8 is an assembled perspective view of FIG. 7.
Figure 9:
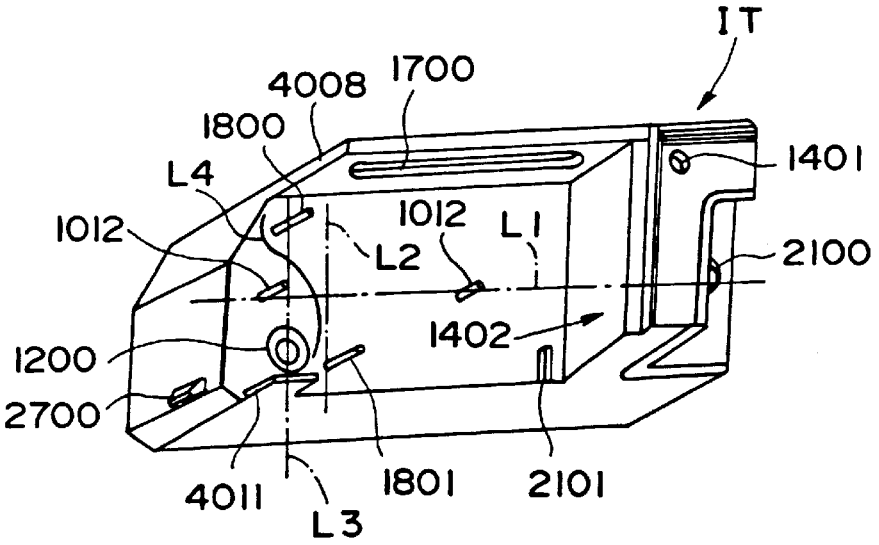
FIG. 9 is a perspective view of the mounting portion of the ink jet unit in FIG. 7.
Figure 10:
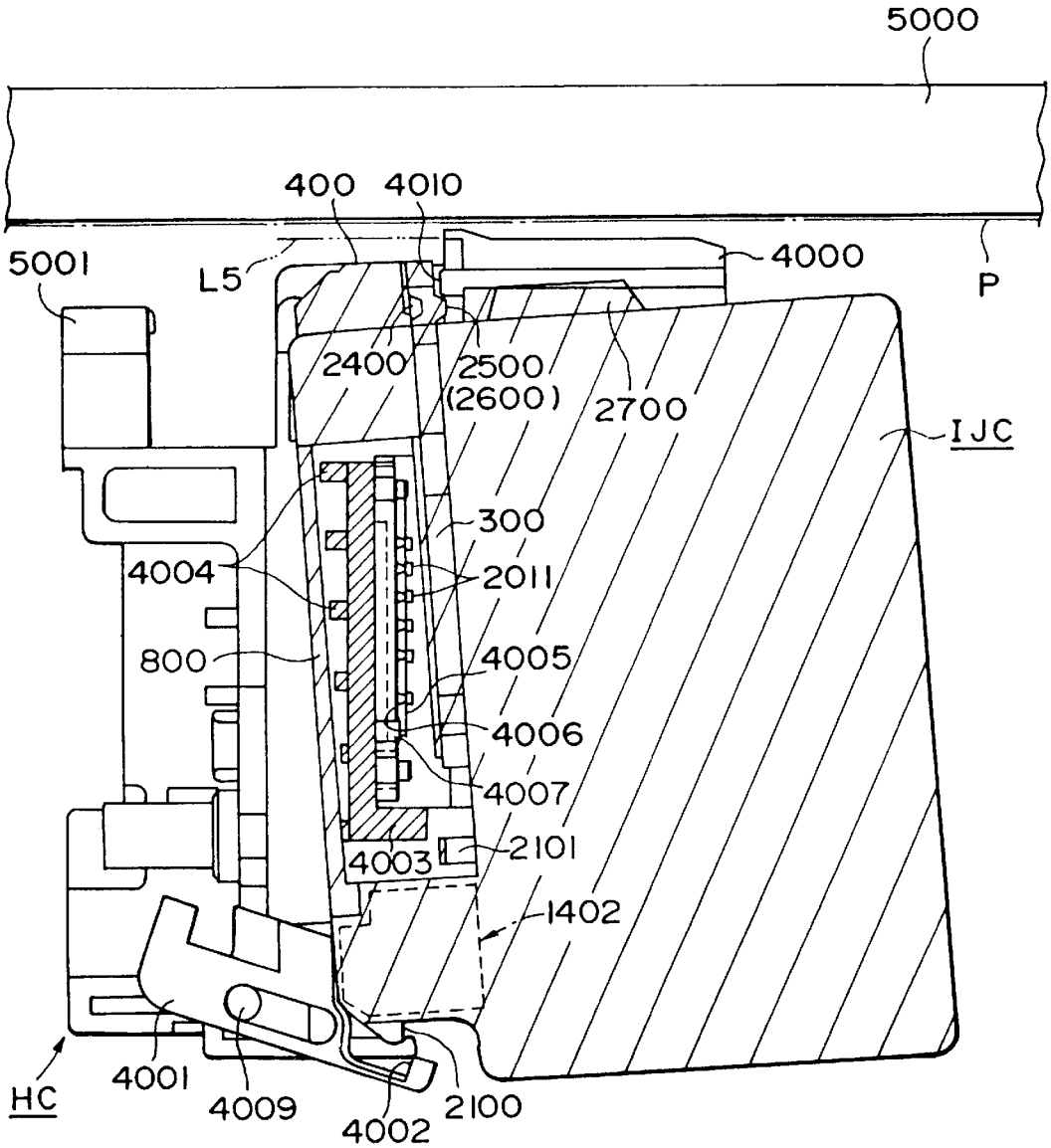
FIG. 10 is an illustration of mounting for the device of the cartridge shown in FIG. 7.
Figure 11:
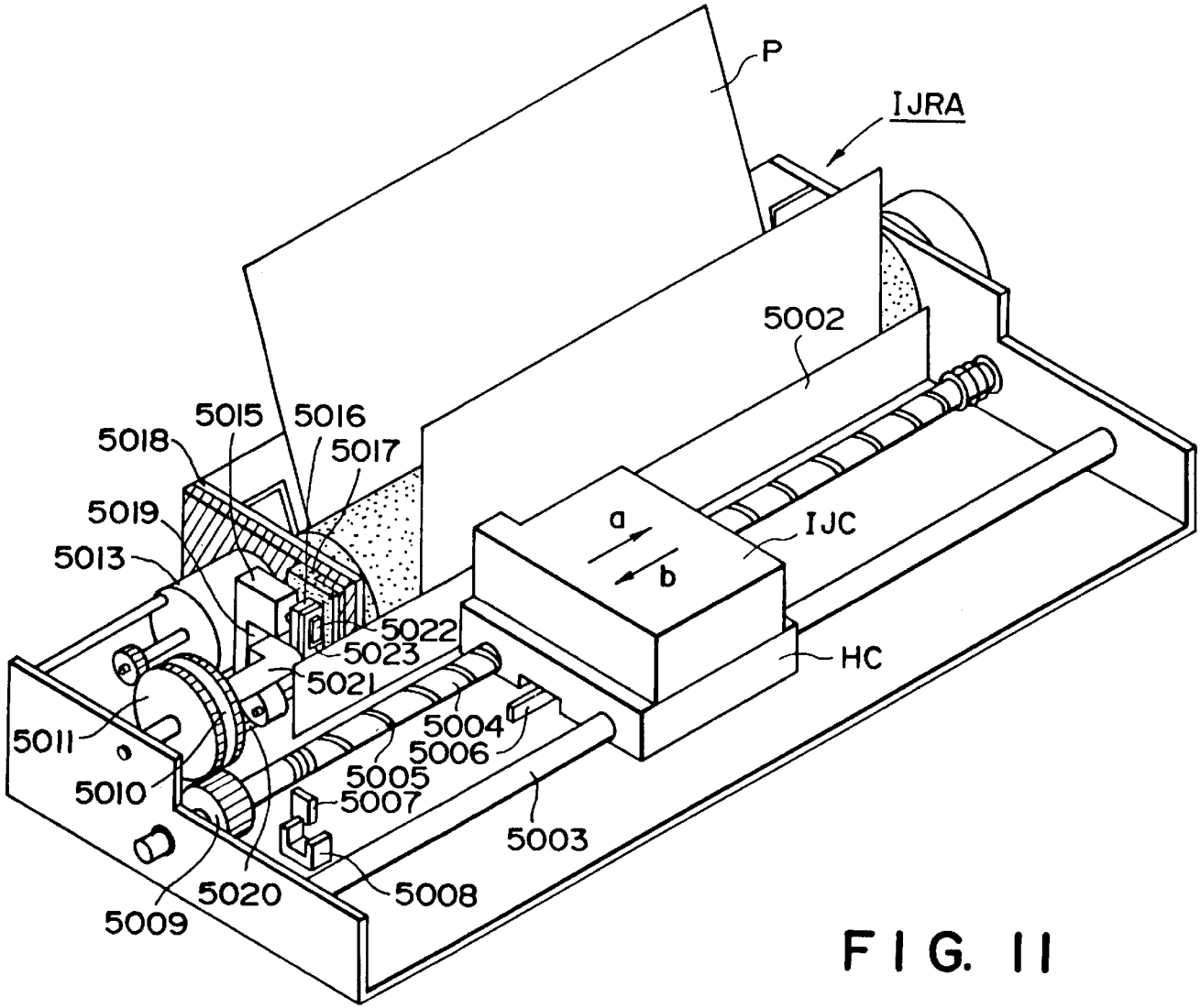
FIG. 11 is an appearance view of the device to which the cartridge shown in FIG. 7 is applied.
Figure 12:
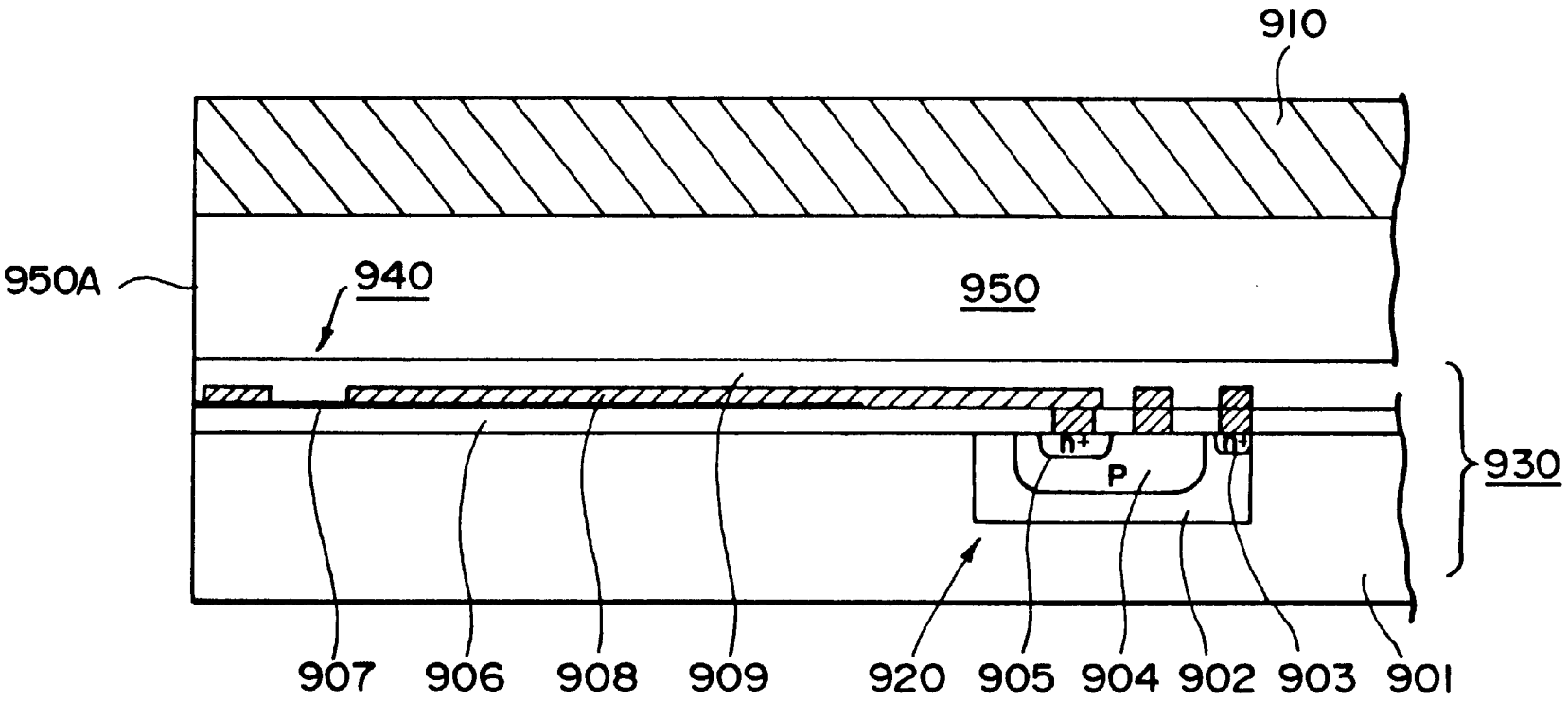
FIG. 12 is a schematic sectional view of the recording head of the prior art.

FIG. 6B shows an embodiment wherein application is changed from the one-dimensional arrangement as described above to the two-dimensional arrangement. The temperature distribution by heat generation at the heater row 124 on the heater board 125 is shown by $T_1$–$T_5$ by the isothermal line representation. Therefore, for obtaining better temperature characteristics, in view of the two-dimensional arrangement, at the line where the temperature becomes the highest as the temperature $T_1$, the diodes $D_{31}$, $D_{41}$, $D_{51}$, $D_{61}$ are applied, which are subjected to the correction methods in the embodiment 1 and the embodiment 2. More specifically, $V_F$ actuation point movement correction or the $V_F$ gradient correction is applied more greatly, with correction being weakened as the temperature influence is weaker as $T_2$ to $T_5$, until the correction amount is made the smallest at the outside of the temperature $T_5$ line, namely at the diodes $D_{16}$, $D_{17}$, $D_{18}$, $D_{28}$, $D_{87}$, $D_{88}$, $D_{78}$. By doing so, $V_F$ correction becomes possible at better temperature.

Here, the matrix is made 1=m×n, and each diode is shown as Dmn.

As described in detail above, according to the present invention, since most parts determining the wiring resistance are constituted with the first layer (lower layer) wiring, by making the first layer wiring thicker, the wiring resistance can be made smaller, and also by making the second layer (upper layer) thinner and the protective layer of the electrothermal transducer thinner, the heater thermal efficiency can be improved without damaging the heater life. Also, there occurs no variance in wiring resistance according to film thickness variance of the first layer, the second layer wiring layers.

Further, since the matrix portion and the functional device array portion are made to have a double structure, the heater board size can be made compact, and the wiring resistance is also reduced as the size is made more compact. Further, it is not cumbersome on account of wiring resistance correction.

In addition, according to the present invention, by arranging diodes with different characteristic curves of normal direction saturated voltage for temperature such as making the size the diodes arranged in the region where the temperature on the heater board becomes higher, and the diodes arranged on the region with lower temperature larger, it becomes possible to make the difference in normal direction voltage of the diode according to the temperature distribution on the heater board without increase of the production, which in turn enables improvement of printing quality.

What is claimed is:

1. A recording head comprising:

a liquid discharge portion having a liquid discharge opening;

a substrate having formed thereon a plurality of electrothermal transducers for generating thermal energy with said electrothermal transducers being arranged in an alignment direction, and a plurality of functional devices also formed on said substrate and electrically connected to said electrothermal transducers in said substrate, each said functional device being disposed at a distance from an associated one of said electrothermal transducers; and a plurality of take-out wires, each of said take-out wires electrically connecting one of the functional devices to an associated one of said electrothermal transducers, said take-out wires extending parallel to each other and being arranged according to a given pitch;

said plurality of functional devices being slipped obliquely with respect to each other on said substrate in the alignment direction of said electrothermal transducers, according to the pitch of said take-out wires, such that said take-out wires become linear to minimize wiring resistance.

2. A recording head according to claim 1, wherein a size of said functional devices is made larger as the distance from said electrothermal transducers is larger.

3. A recording head according to claim 1, wherein a temperature dependency of said functional devices is made larger as the distance from said electrothermal transducers is larger.

4. A recording head according to claim 1, wherein said plurality of functional devices are electrically connected to said electrothermal transducers on and internally of said substrate.

5. A substrate for a recording head, said substrate comprising:

a plurality of electrothermal transducers for generating thermal energy, said electrothermal transducers being formed on said substrate and being arranged in an alignment direction;

a plurality of functional devices also formed on said substrate and being electrically connected to said electrothermal transducers in said substrate, each said functional device being disposed at a distance from an associated one of said electrothermal transducers; and a plurality of take-out wires, each of said take-out wires electrically connecting one of said functional devices to an associated one of said electrothermal transducers, said take-out wires extending parallel to each other and being arranged according to a given pitch;

said plurality of functional devices being slipped obliquely with respect to each other on said substrate in the alignment direction of said electrothermal transducers, according to the pitch of said take-out wires, such that said take-out wires become linear to minimize wiring resistance.

6. A substrate for a recording head according to claim 5, wherein a size of said functional devices is made larger as the distance from said electrothermal transducers is larger.

7. A substrate for a recording head according to claim 5, wherein a temperature dependency of said functional devices is made larger as the distance from said electrothermal transducers is larger.

8. A substrate according to claim 5, wherein said plurality of functional devices are electrically connected to said electrothermal transducers on and internally of said substrate.

9. An ink jet recording apparatus comprising:

a recording head including a liquid discharge portion having a liquid discharge opening and, a substrate having formed thereon a plurality of electrothermal transducers for generating thermal energy with said electrothermal transducers being arranged in an alignment direction, and a plurality of functional devices also formed on said substrate and electrically connected to said electrothermal transducers in said substrate, each said functional device being disposed at a distance from an associated one of said electrothermal transducers; and a plurality of take-out wires, each of said take-out wires electrically connecting one of said functional devices to an associated one of said electrothermal transducers, said take-out wires extending parallel to each other and being arranged according to a given pitch;

said plurality of functional devices being slipped obliquely with respect to each other on said substrate in the alignment direction of said electrothermal transducers, according to the pitch of said take-out wires, such that said take-out wires become linear to minimize wiring resistance.

10. An ink jet recording apparatus according to claim 9, wherein said plurality of functional devices are electrically connected to said electrothermal transducers on and internally of said substrate.

* * * * *

UNITED STATES PATENT AND TRADEMARK OFFICE

CERTIFICATE OF CORRECTION

PATENT NO. : 6,113,220
DATED : September 5, 2000
INVENTOR(S) : Hiroyuki Ishinaga, et al.

It is certified that error appears in the above-identified patent and that said Letters Patent is hereby corrected as shown below:

Title page,
Item [56] References Cited, under FOREIGN PATENT DOCUMENTS "354103054" should read -- 54-103054 --.

Column 1,
Line 54, "906" should read -- Numeral 906 --.

Column 5,
Line 2, "f" should read -- of --.

Column 9,
Line 15, "was" should read -- were, --.

Column 11,
Line 24, "and the" should read -- and --.

Column 13,
Line 61, "becomes" should read -- become --.

Column 15,
Line 51, "size" should read -- size of --; and
Line 57, "the" (last occurrence) should be deleted.

Signed and Sealed this

Twenty-first Day of August, 2001

*Attest:*

Nicholas P. Godici

*Attesting Officer*

NICHOLAS P. GODICI
*Acting Director of the United States Patent and Trademark Office*